US008919251B2

(12) United States Patent
Hirano et al.

(10) Patent No.: US 8,919,251 B2
(45) Date of Patent: Dec. 30, 2014

(54) INK FILM THICKNESS DISTRIBUTION CORRECTION METHOD AND APPARATUS

(75) Inventors: Masahiro Hirano, Ibaraki (JP); Hiromichi Totsuka, Ibaraki (JP)

(73) Assignee: Komori Corporation, Tokyo (JP)

( * ) Notice: Subject to any disclaimer, the term of this patent is extended or adjusted under 35 U.S.C. 154(b) by 133 days.

(21) Appl. No.: 13/600,169

(22) Filed: Aug. 30, 2012

(65) Prior Publication Data

US 2013/0061768 A1 Mar. 14, 2013

(30) Foreign Application Priority Data

Sep. 12, 2011 (JP) ..... 2011-198381

(51) Int. Cl.

| | |
|---|---|
| ***B41F 31/30*** | (2006.01) |
| ***B41F 31/20*** | (2006.01) |
| ***B41F 35/04*** | (2006.01) |
| ***B41F 33/10*** | (2006.01) |
| ***B41F 31/04*** | (2006.01) |
| ***B41F 33/00*** | (2006.01) |

(52) U.S. Cl.

CPC ..... *B41F 31/045* (2013.01); *B41F 31/301* (2013.01); *B41F 33/0045* (2013.01)

USPC ..... 101/351.3; 101/425; 101/484

(58) Field of Classification Search

CPC ..... B41F 31/301; B41F 31/302; B41F 31/10; B41F 31/12; B41F 31/045; B41F 35/04; B41P 2233/11; B41P 2233/51

USPC ..... 101/351.3, 351.4, 351.2, 352.04, 101/352.01, 352.02, 352.03, 352.05, 365, 101/484, DIG. 45, DIG. 47

See application file for complete search history.

(56) References Cited

U.S. PATENT DOCUMENTS

| | | | | |
|---|---|---|---|---|
| 3,701,316 | A * | 10/1972 | Sylvester et al. | 101/148 |
| 4,882,991 | A * | 11/1989 | Simeth | 101/350.2 |
| 5,365,849 | A * | 11/1994 | Spiegel | 101/423 |
| 6,116,161 | A * | 9/2000 | Voge et al. | 101/483 |
| 6,615,728 | B2 * | 9/2003 | Kurata et al. | 101/484 |
| 6,712,002 | B2 * | 3/2004 | Herbst et al. | 101/351.1 |
| 8,201,903 | B2 * | 6/2012 | Hirano | 347/7 |
| 2004/0125156 | A1 | 7/2004 | Hirano et al. | |
| 2006/0102030 | A1 | 5/2006 | Hirano | |
| 2007/0022888 | A1 * | 2/2007 | Inde et al. | 101/365 |
| 2011/0032289 | A1 | 2/2011 | Hirano | |

FOREIGN PATENT DOCUMENTS

| | | | |
|---|---|---|---|
| CN | 1511702 | A | 7/2004 |
| CN | 1772483 | A | 5/2006 |
| CN | 101992587 | A | 3/2011 |

(Continued)

*Primary Examiner* — Ren Yan
*Assistant Examiner* — Leo T Hinze
(74) *Attorney, Agent, or Firm* — Blakely Sokoloff Taylor & Zafman

(57) ABSTRACT

An ink film thickness distribution correction method in an ink supply apparatus including an ink fountain storing an ink, a plurality of ink fountain keys, an ink fountain roller to which the ink is supplied from the ink fountain, an ink ductor roller to which the ink is transferred from the ink fountain roller, and an ink roller group including at least one ink form roller to which the ink transferred to the ink ductor roller is supplied. A throw-off operation of the ink form roller positioned at the end of the ink roller group is performed during test printing or final printing. An ink film thickness distribution correction apparatus is also disclosed.

4 Claims, 33 Drawing Sheets

(56) References Cited

FOREIGN PATENT DOCUMENTS

| | | | |
|---|---|---|---|
| EP | 0 257 365 | A3 | 3/1988 |
| EP | 1 083 047 | A1 | 3/2001 |
| JP | S58-201008 | A | 11/1983 |
| JP | S58-201010 | A | 11/1983 |
| JP | H10-016193 | A | 1/1998 |
| JP | H11-188844 | A | 7/1999 |
| JP | 2001-322250 | A | 11/2001 |

* cited by examiner

INK FILM THICKNESS DISTRIBUTION CORRECTION METHOD AND APPARATUS

BACKGROUND OF THE INVENTION

The present invention relates to an ink film thickness distribution correction method and apparatus for correcting an ink film thickness distribution formed in an ink roller group in an ink supply apparatus.

FIG. 12 shows the main part of an inker (ink supply apparatus) in a printing unit of each color in a web offset printing press. In FIG. 12, the inker includes an ink fountain 1, an ink 2 stored in the ink fountain 1, an ink fountain roller 3, a plurality of ink fountain keys 4 (4-1 to 4-n) juxtaposed in the axial direction of the ink fountain roller 3, an ink ductor roller 5, an ink roller group 6, a printing plate 7, and a plate cylinder 8 on which the printing plate 7 is mounted. An image is printed on the printing plate 7. The ink fountain 1, ink fountain roller 3, ink fountain keys 4, ink ductor roller 5, and ink roller group 6 form an ink supply path for supplying ink in the ink fountain 1 to the printing plate 7.

In the ink supply apparatus, the ink 2 in the ink fountain 1 is supplied to the ink fountain roller 3 by adjusting the opening degrees of the ink fountain keys 4-1 to 4-n. The ink supplied to the ink fountain roller 3 is supplied to the printing plate 7 via the ink roller group 6 by the ink feed operation of the ink ductor roller 5. The ink supplied to the printing plate 7 is printed on a printing sheet via a blanket cylinder (not shown). Note that ink form rollers 6-1 to 6-4 in contact with the printing plate 7 are arranged at the end of the ink flow path of the ink roller group 6.

FIG. 13 shows a printing product printed by the printing press. A band-shaped color bar 9-2 is printed in a margin except for an image region 9-1. In general four-color printing, the color bar 9-2 is formed from regions S1 to Sn each including black, cyan, magenta, and yellow density measurement patches (solid patches with 100% dot area). The regions S1 to Sn correspond to the key zones of the ink fountain keys 4-1 to 4-n in printing units of respective colors in the printing press.

[Color Matching]

Reference density values are set in advance for printing units of respective colors. More specifically, reference density values are set in advance for black, cyan, magenta, and yellow. When printing a printing product 9, color matching work is performed to make the density values of the respective colors match their reference density values. An ink supply amount control apparatus performs this color matching work during test printing or final printing based on the densities of density measurement patches 9*a* (9*a*1, 9*a*2, 9*a*3, and 9*a*4) of the respective colors on the color bar 9-2 printed on the printing product 9.

For example, the region S1 on the printing product 9 will be explained as a representative. The density value of the density measurement patch 9*a* of each color of the printing product 9 obtained by test printing or final printing is measured. The density difference between the measured density value of each color and a preset reference density value of this color is obtained. From the obtained density difference of each color, the correction amount (correction amount of the ink supply amount to the region S1) of the opening ratio of the ink fountain key 4-1 in the printing unit of this color is obtained. The opening ratio of the ink fountain key 4-1 in the printing unit of each color is adjusted using the obtained correction amount as a feedback amount.

As for the regions S2 to Sn, the correction amounts (correction amounts of the ink supply amounts to the regions S2 to Sn) of the opening ratios of the ink fountain keys 4-2 to 4-n in the printing units of the respective colors are obtained in the same way. The opening ratios of the ink fountain keys 4-2 to 4-n in the printing units of the respective colors are adjusted using the obtained correction amounts as feedback amounts. Immediately after the opening ratios of the ink fountain keys 4-1 to 4-n are adjusted, printing restarts. This operation is repeated until the density values of the respective colors reach their reference density values.

However, in this ink supply amount adjustment method, when the density of a printing product becomes excessively high during test printing or final printing, excessive ink in the ink supply apparatus hardly decreases by only decreasing the opening ratio of the ink fountain key. Many wasted sheets are generated, wasting printing materials. In addition, time is taken, decreasing the operation rate.

To efficiently correct an ink film thickness distribution in the ink supply apparatus during test printing or final printing, there have been proposed an ink film thickness correction method disclosed in Japanese Patent Laid-Open No. 10-16193 (literature 1), and an ink film thickness control method disclosed in Japanese Patent Laid-Open No. 11-188844 (literature 2).

[Literature 1 (Ink-Removing+Pre-Inking 2)]

In the ink film thickness correction method described in literature 1, when correcting an ink film thickness distribution in the ink supply apparatus during test printing or final printing, the ink feed operation of the ink ductor roller 5 is stopped. In this state, a predetermined number of sheets are printed (blank sheet printing), decreasing ink in the ink supply apparatus (ink-decrease). A minimum ink film thickness distribution Ma (see FIG. 14A) which thins from the upstream side to downstream side of the ink roller group 6 and is required during printing, that is, an ink film thickness distribution Ma corresponding to an image-free portion of the printing plate 7 remains. Then, a modified ink film thickness distribution Mb (see FIG. 14B) is superposed on the remaining ink film thickness distribution Ma (pre-inking 2).

[Literature 2 (Pre-inking (−)="Ink-Returning to Fountain"+ Pre-Inking 1)]

In the ink film thickness control method described in literature 2, when correcting an ink film thickness distribution in the ink supply apparatus during test printing or final printing, the opening ratios of all the ink fountain keys 4-1 to 4-n are set to 0. In this state, the ink feed operation of the ink ductor roller 5 is performed by a predetermined number of times, returning all ink remaining in the ink supply apparatus to the ink fountain 1 ("Ink-returning to fountain"). After that, a minimum ink film thickness distribution Ma (see FIG. 14A) required during printing is formed in the ink roller group 6 (first step of pre-inking 1). A modified ink film thickness distribution Mb (see FIG. 14B) is superposed on the formed ink film thickness distribution Ma (second step of pre-inking 1).

However, the ink film thickness control method described in literature 1 wastes sheets because blank sheet printing is executed when leaving the ink film thickness distribution Ma on the ink roller group 6.

The ink film thickness control method described in literature 2 takes time because all ink on the ink roller group 6 is returned to the ink fountain 1 and an ink film thickness distribution (Ma+Mb) modified from 0 is formed. In this method, emulsified ink (ink kneaded with damping water) is returned to the ink fountain 1. A printing trouble may occur, wasting printing materials.

SUMMARY OF THE INVENTION

The present invention has been made to solve the above problems, and has as its object to provide an ink film thickness distribution forming method and apparatus capable of correcting an ink film thickness distribution formed in an ink roller group within a short time without performing blank sheet printing or "ink return to fountain" during test printing or final printing.

In order to achieve the above-described object, there is provided an ink film thickness distribution correction method in an ink supply apparatus including an ink fountain storing an ink, a plurality of ink fountain keys arranged in the ink fountain, an ink fountain roller to which the ink is supplied from the ink fountain in accordance with opening ratios of the plurality of ink fountain keys, an ink ductor roller to which the ink is transferred from the ink fountain roller by an ink feed operation, and an ink roller group including at least one ink form roller to which the ink transferred to the ink ductor roller is supplied, comprising the steps of performing a throw-off operation of the ink form roller positioned at an end of the ink roller group during test printing or final printing, stopping the ink feed operation of the ink ductor roller during test printing or final printing, dividing the ink roller group into a plurality of roller subgroups during test printing or final printing, and removing the ink in at least one of roller subgroups out of the divided roller subgroups.

According to the present invention, ink form rollers positioned at the end of the ink flow path of an ink roller group are thrown off during test printing or final printing, and the ink feed operation of the ink ductor roller is stopped. Then, the ink roller group is divided into a plurality of roller subgroups, and ink in at least one of the divided roller subgroups is removed. The ink in at least one of roller subgroups is removed by, for example, using an ink cleaning device or scraping the ink by a blade. Hence, an ink film thickness distribution formed in the ink roller group can be corrected within a short time without performing blank sheet printing or "ink return to fountain" during test printing or final printing.

DESCRIPTION OF THE PREFERRED EMBODIMENT

The present invention will be described in detail below with reference to the accompanying drawings.

Figure 1:
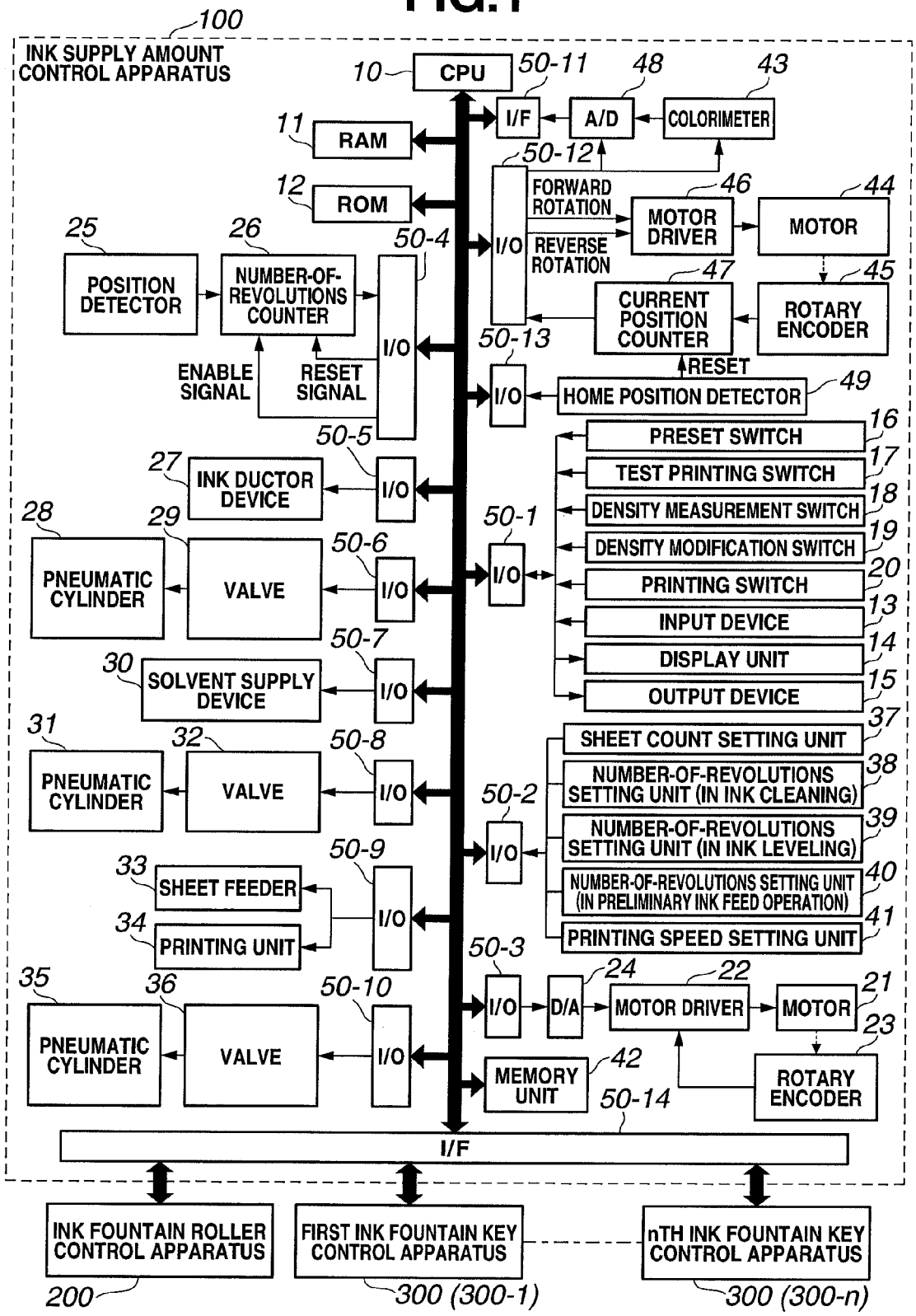
FIG. 1 is a block diagram showing an ink supply amount control apparatus according to an embodiment of the present invention.

As shown in FIG. 1, an ink supply amount control apparatus 100 according to the embodiment includes a CPU 10, a RAM 11, a ROM 12, an input device 13, a display unit 14, an output device (e.g., printer) 15, a preset start switch 16, a test printing start switch 17, a density measurement switch 18, a density modification switch 19, a printing start switch 20, a printing press drive motor 21, a drive motor driver 22, a drive motor rotary encoder 23, a D/A converter 24, a printing press home position detector 25, a counter 26 for counting the number of revolutions of a printing press, and an ink ductor device 27.

The ink supply amount control apparatus 100 includes a roller group division/coupling pneumatic cylinder 28, a roller group division/coupling pneumatic cylinder valve 29, a solvent supply device 30, a doctor throw-on/off pneumatic cylinder 31, a doctor throw-on/off pneumatic cylinder valve 32, a sheet feeder 33, a printing unit 34, an ink form roller throw-on/off pneumatic cylinder 35, an ink form roller throw-on/off pneumatic cylinder valve 36, a test printing sheet count setting unit 37, a number-of-revolutions setting unit 38 in ink cleaning, a number-of-revolutions setting unit 39 in ink leveling, a number-of-revolutions setting unit 40 in a preliminary ink feed operation, a printing speed setting unit 41, and a memory unit 42.

The ink supply amount control apparatus 100 further includes a colorimeter 43, a colorimeter moving motor 44, a colorimeter moving motor rotary encoder 45, a colorimeter moving motor driver 46, a current colorimeter position detection counter 47, an A/D converter 48, a colorimeter home position detector 49, and input/output interfaces (I/O I/Fs) 50-1 to 50-14.

Figure 2:
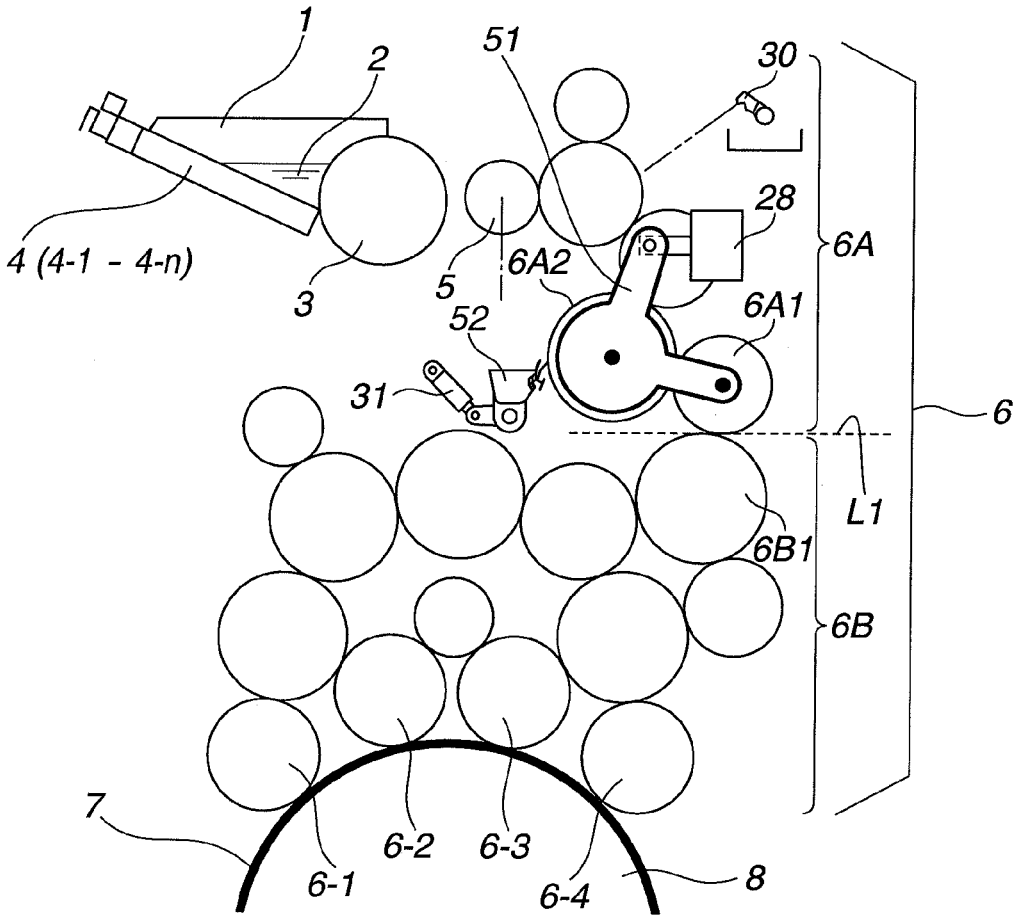
FIG. 2 is a view showing the main part (coupling state before dividing an ink roller group) of an ink supply apparatus to be controlled by the ink supply amount control apparatus shown in FIG. 1.
Figure 12:
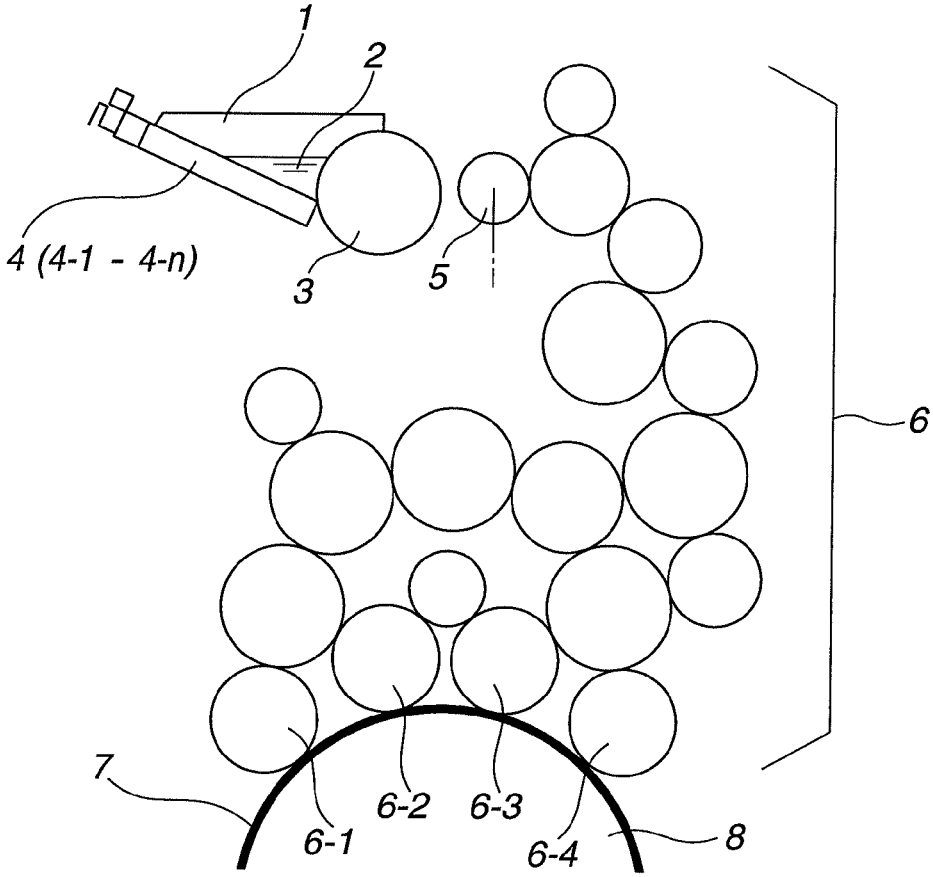
FIG. 12 is a view showing the main part of an ink supply apparatus in a printing unit of each color in a printing press.
Figure 13:
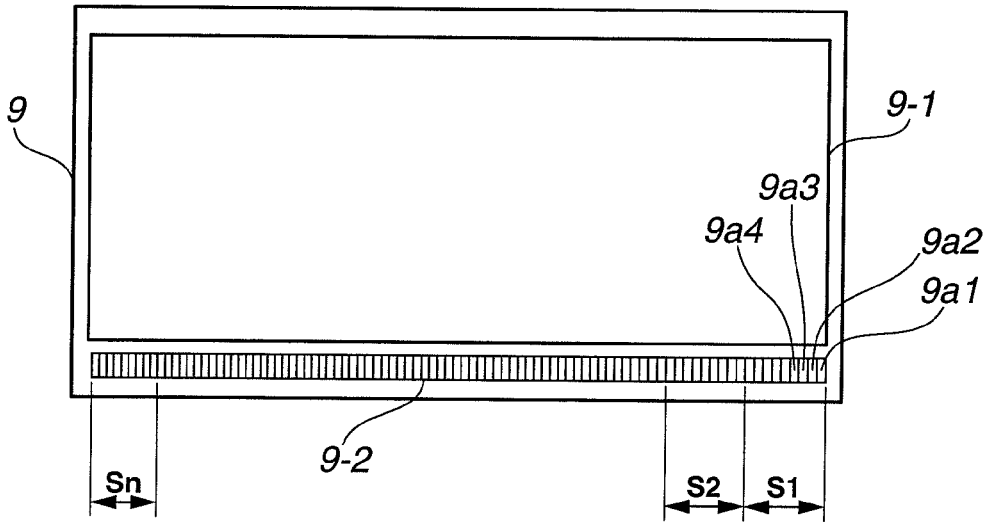
FIG. 13 is a plan view schematically showing a printing product printed by the printing press.
Figure 14A:
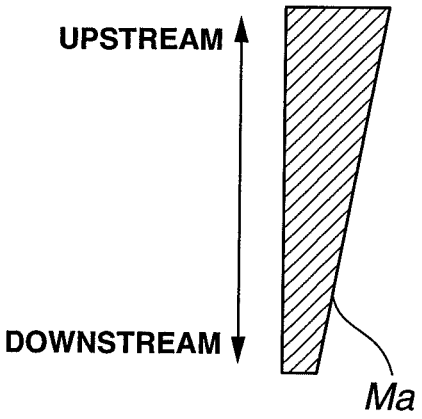
FIGS. 14A and 14B are views showing ink film thickness distributions Ma and Mb formed on the ink roller group of the ink supply apparatus.
Figure 14B:
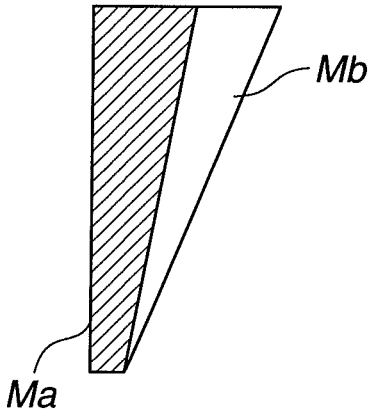

In FIG. 2, the same reference numerals as those in FIG. 12 denote the same or similar parts as those shown in FIG. 12, and a description thereof will not be repeated. In an ink supply apparatus shown in FIG. 2, an ink roller group 6 which forms an ink supply path can be divided into an upstream roller subgroup 6A and downstream roller subgroup 6B at the boundary of a dotted line L1.

More specifically, a roller 6A1 positioned at the lowermost end of the ink flow path of the upstream roller subgroup 6A is axially supported by one end of a swing arm 51 which swings about, as the pivot center, the axis of a roller 6A2 which contacts the outer surface of the roller 6A1. The pneumatic cylinder 28 is coupled to the other end of the swing arm 51.

In this structure, when the pneumatic cylinder 28 extends (see FIG. 3), the swing arm 51 swings in a direction indicated by an arrow A about the axis of the roller 6A2 serving as the pivot center. As the swing arm 51 swings, the roller 6A1 moves apart from a roller 6B1 positioned at the uppermost end of the ink flow path of the downstream roller subgroup 6B while rolling on the roller 6A2. As a result, the ink roller group 6 is divided into the upstream roller subgroup 6A and downstream roller subgroup 6B.

When the pneumatic cylinder 28 contracts from this state, the swing arm 51 swings in a direction indicated by an arrow B about the axis of the roller 6A2 serving as the pivot center. As the swing arm 51 swings, the roller 6A1 comes into contact with the outer surface of the roller 6B1 at the uppermost end of the downstream roller subgroup 6B while rolling on the roller 6A2 (see FIG. 2). Accordingly, the upstream roller subgroup 6A and downstream roller subgroup 6B are coupled and return to the single ink roller group 6.

The ink roller group 6 includes the solvent supply device 30 which injects a solvent from the upstream side of the upstream roller subgroup 6A, and a doctor 52 which comes into contact with the outer surface of the roller 6A2 of the upstream roller subgroup 6A to recover the solvent. The doctor 52 includes the doctor throw-on/off pneumatic cylinder 31. When recovering the solvent, the pneumatic cylinder 31 extends to bring the doctor 52 into contact with the outer surface of the roller 6A2. When the pneumatic cylinder 31 contracts, the doctor 52 moves apart from the outer surface of the roller 6A2.

In FIG. 1, the CPU 10 obtains various kinds of information input via the interfaces 50-1 to 50-14. While accessing the RAM 11 and memory unit 42, the CPU 10 operates in accordance with a program stored in the ROM 12.

The rotary encoder 23 generates a rotation pulse at every predetermined rotation angle of the motor 21, and outputs it to the motor driver 22. The printing press home position detector 25 detects a home position in every rotation of the printing press, generates a home position detection signal, and outputs it to the counter 26 for counting the number of revolutions of the printing press.

The ink ductor device 27 is arranged for the ink ductor roller 5. When the ink ductor device 27 is turned on, the ink feed operation of the ink ductor roller 5 starts. When the ink ductor device 27 is turned off, the ink feed operation of the ink ductor roller 5 stops. The pneumatic cylinder 35 is arranged for ink form rollers 6-1 to 6-4. When the pneumatic cylinder 35 extends, the ink form rollers 6-1 to 6-4 are thrown on (come into contact with a printing plate 7). When the pneumatic cylinder 35 contracts, the ink form rollers 6-1 to 6-4 are thrown off (move apart from the printing plate 7).

Figure 4A:
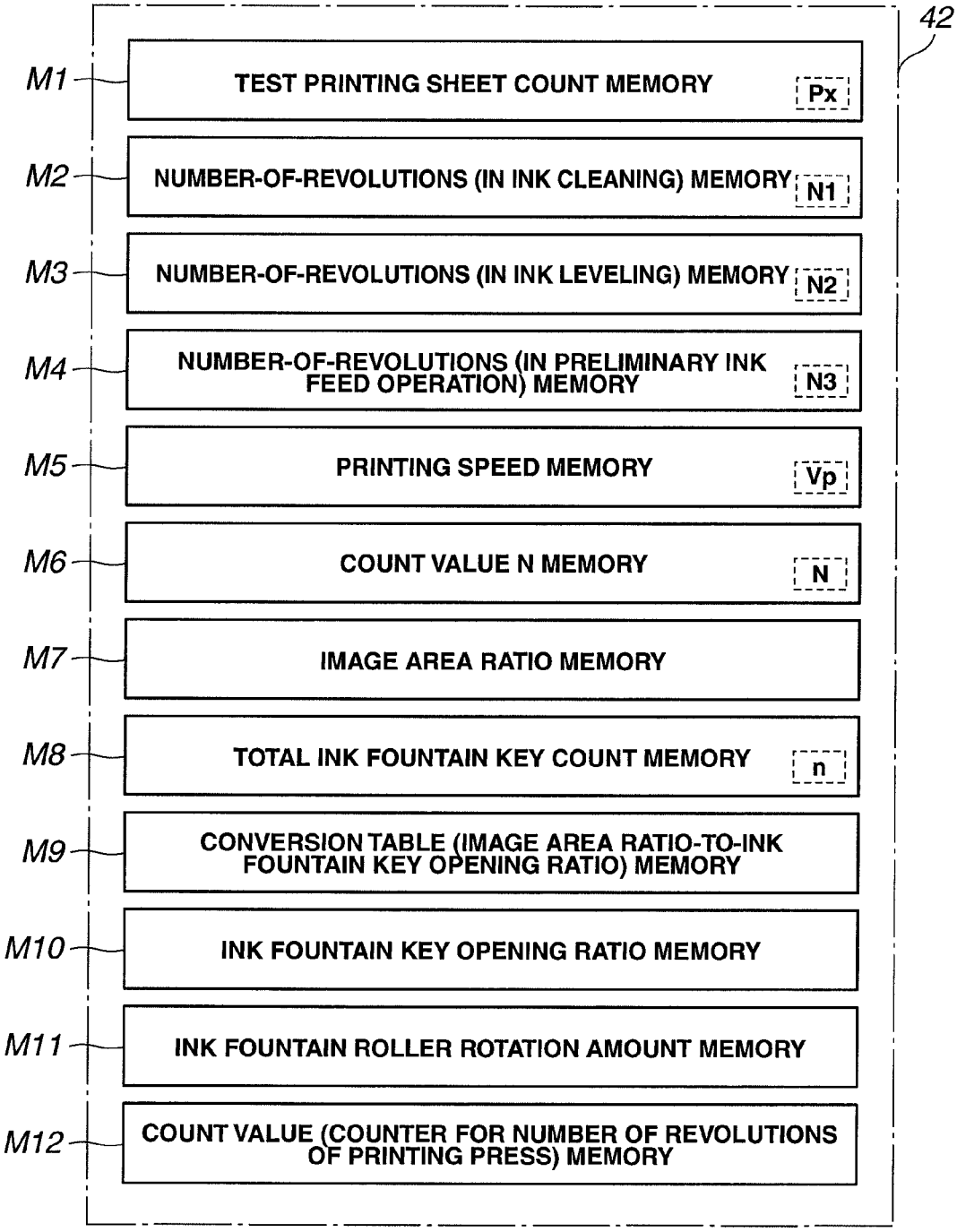
FIGS. 4A and 4B are views showing details of the memory unit of the ink supply amount control apparatus shown in FIG. 1.
Figure 4B:
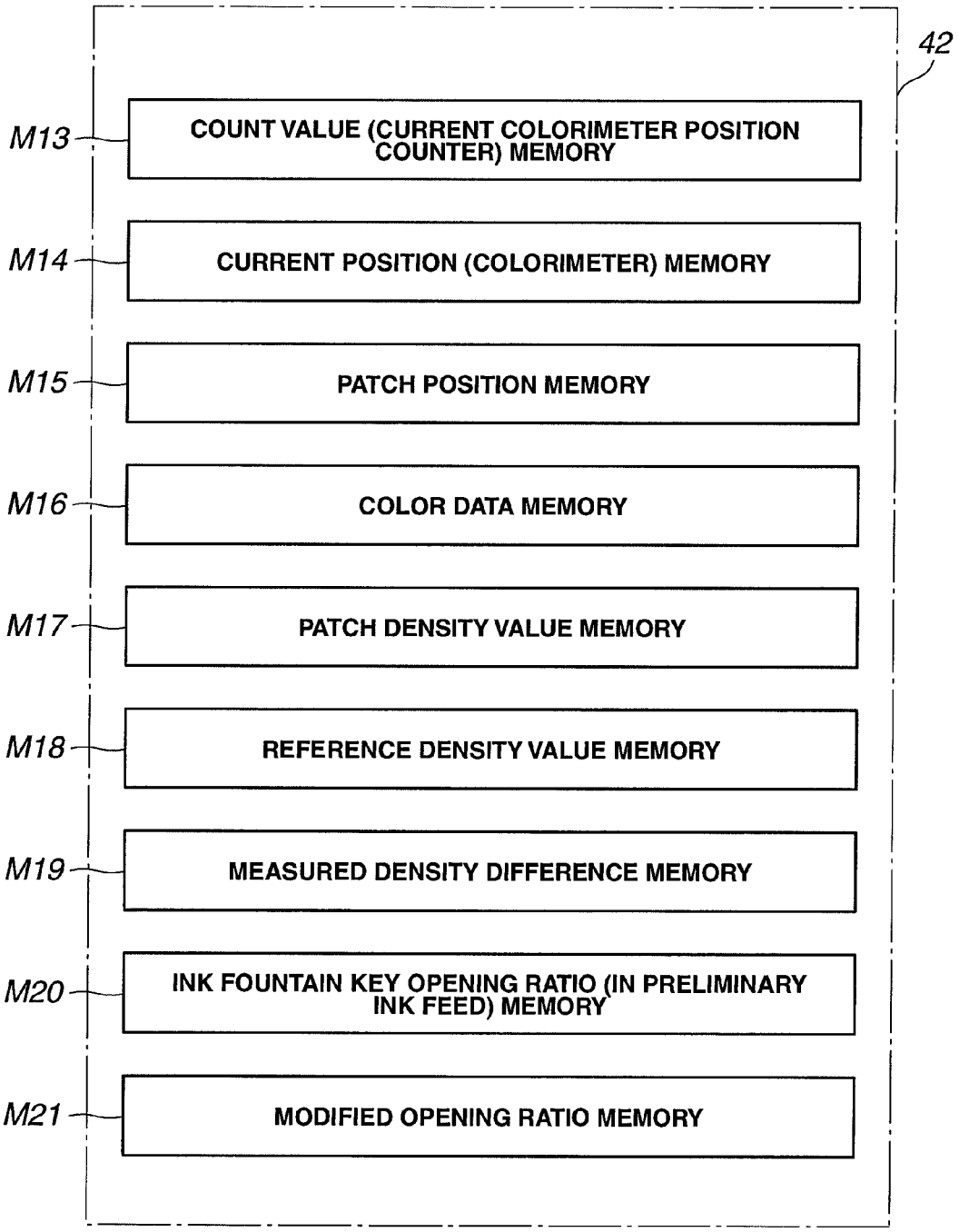

FIGS. 4A and 4B divisionally show the memory unit 42. The memory unit 42 includes memories M1 to M21. The test printing sheet count memory M1 stores a test printing sheet count Px. The number-of-revolutions memory M2 stores the number N1 of revolutions of the printing press in ink cleaning. The number-of-revolutions memory M3 stores the number N2 of revolutions of the printing press in ink leveling. The number-of-revolutions memory M4 stores the number N3 of revolutions of the printing press in the preliminary ink feed operation. The printing speed memory M5 stores a printing speed Vp. The count value N memory M6 stores a count value N. The image area ratio memory M7 stores the image area ratio of a range corresponding to each ink fountain key.

The total ink fountain key count memory M8 stores a total ink fountain key count n. The conversion table memory M9 stores an image area ratio-to-ink fountain key opening ratio conversion table representing the relationship between the image area ratio and the opening ratio of the ink fountain key. The ink fountain key opening ratio memory M10 stores the opening ratio of each ink fountain key. The ink fountain roller rotation amount memory M11 stores the rotation amount of the ink fountain roller. The count value memory M12 stores the count value of the counter for counting the number of revolutions of the printing press.

The count value memory M13 stores the count value of the current colorimeter position detection counter. The current position memory M14 stores the current position of the colorimeter. The patch position memory M15 stores the position of each patch of a test printing sample to be measured by the colorimeter. The color data memory M16 stores color data from the colorimeter. The patch density value memory M17 stores the density value of each patch of the test printing sample. The reference density value memory M18 stores a reference density value. The measured density difference memory M19 stores the difference (measured density difference) between the density value of each patch of the test printing sample and the reference density value. The ink fountain key opening ratio memory M20 stores the opening ratio of each ink fountain key in preliminary ink feed. The modified opening ratio memory M21 stores the modified opening ratio of each ink fountain key.

Figure 5:
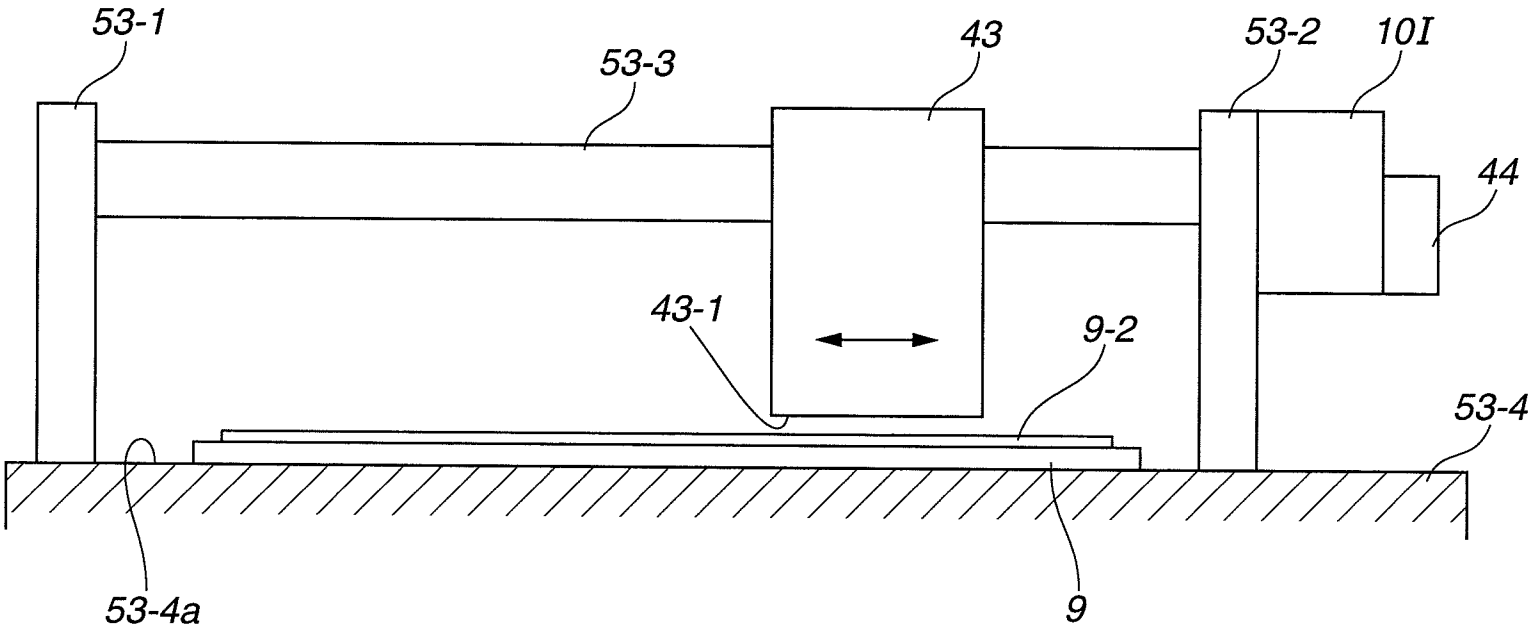
FIG. 5 is a side view showing the installation state of a colorimeter shown in FIG. 1.

As shown in FIG. 5, the colorimeter 43 is attached to a ball screw (feed screw) 53-3 interposed between columns 53-1 and 53-2. The ball screw 53-3 rotates forward/reverse along with rotation of the motor 44. While the colorimeter 43 is guided by the ball screw 53-3 along with forward/reverse rotation of the ball screw 53-3, it moves between the columns 53-1 and 53-2. A head 43-1 of the colorimeter 43 faces a surface 53-4*a* of a measurement table 53-4 on which a measurement target is placed.

In FIG. 1, an ink fountain roller control apparatus 200 drives the ink fountain roller 3 in the ink supply apparatus. Ink fountain key control apparatuses 300-1 to 300-n control the opening ratios of the ink fountain keys 4-1 to 4-n in the ink supply apparatus. The ink fountain roller control apparatus 200 and ink fountain key control apparatuses 300-1 to 300-n are arranged for ink supply apparatuses of respective colors. However, the embodiment will explain one ink supply apparatus for descriptive convenience. That is, the operation of one of the ink supply apparatuses will be explained as a representative.

[Schematic Operation of Ink Supply Amount Control Apparatus]

Before a description of the detailed operation of the ink supply amount control apparatus 100, a schematic operation will be explained as steps (1) to (13) below to facilitate understanding.

Figures 6A, 6B, 6C, 6D, 6E:
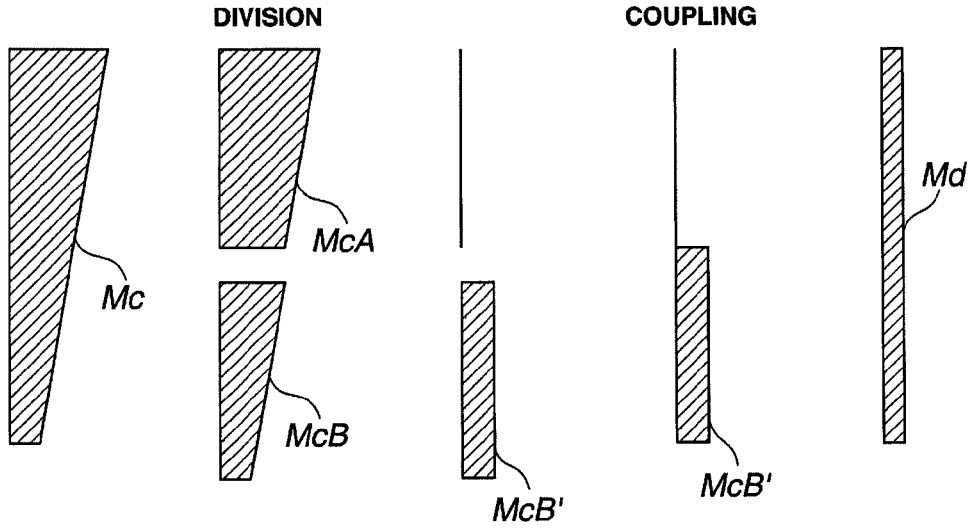
FIGS. 6A to 6I are views showing correction processes for the ink film thickness distribution of the ink roller group during test printing.

(1) Test Printing Starts (2) After test printing by a predetermined number of sheets, sheet feed stops. Then, the ink form rollers 6-1 to 6-4 are thrown off, and printing (test printing) using the printing plate 7 is stopped. In this case, an ink film thickness distribution Mc corresponding to an image on the printing plate 7 remains in the ink roller group 6, as shown in FIG. 6A. That is, the ink film thickness distribution Mc during test printing remains.

(3) The density values of density measurement patches printed in ranges corresponding to the ink fountain keys 4-1 to 4-n on a printing product (test printing sample) printed by test printing are measured.

(4) The opening ratios of the ink fountain keys 4-1 to 4-n in preliminary ink feed and modified opening ratios (opening ratios in printing after preliminary ink feed) are obtained from differences between the measured density value measurement patches and reference density values, and the image area ratios of the ranges corresponding to the ink fountain keys 4-1 to 4-n.

(5) The opening ratios in preliminary ink feed that have been obtained in step (4) are set as the opening ratios of the ink fountain keys 4-1 to 4-n.

(6) The ink feed operation of the ink ductor roller 5 is stopped while the printing press stops. The ink roller group 6 is divided into the upstream roller subgroup 6A and downstream roller subgroup 6B. As shown in FIG. 6B, the ink film thickness distribution Mc of the ink roller group 6 is divided into an ink film thickness distribution McA of the upstream roller subgroup 6A and an ink film thickness distribution McB of the downstream roller subgroup 6B.

(7) The rotational speed of the printing press is increased to 8,000 rph, and an ink cleaning device formed from the solvent supply device 30 and doctor 52 is turned on. In this state, the printing press rotates by a predetermined number of revolutions (number N1 of revolutions in ink cleaning), cleaning ink in the upstream roller subgroup 6A. Hence, the ink film thickness distribution McA of the upstream roller subgroup 6A becomes almost 0, as shown in FIG. 6C. At this time, the ink film thickness distribution of the downstream roller subgroup 6B is leveled by the number N1 of revolutions in ink cleaning, obtaining a flat ink film thickness distribution McB'.

(8) The upstream roller subgroup 6A and downstream roller subgroup 6B are coupled and return to the single ink roller group 6 (FIG. 6D). Thereafter, the printing press rotates by a predetermined number of revolutions (number N2 of revolutions in ink leveling). The ink film thickness distribution McB' remaining in the downstream roller subgroup 6B is leveled between the downstream roller subgroup 6B and the upstream roller subgroup 6A, forming a thin, flat ink film thickness distribution (basic ink film thickness distribution) Md (FIG. 6E) in the ink roller group 6.

Figures 6F, 6G, 6H, 6I:
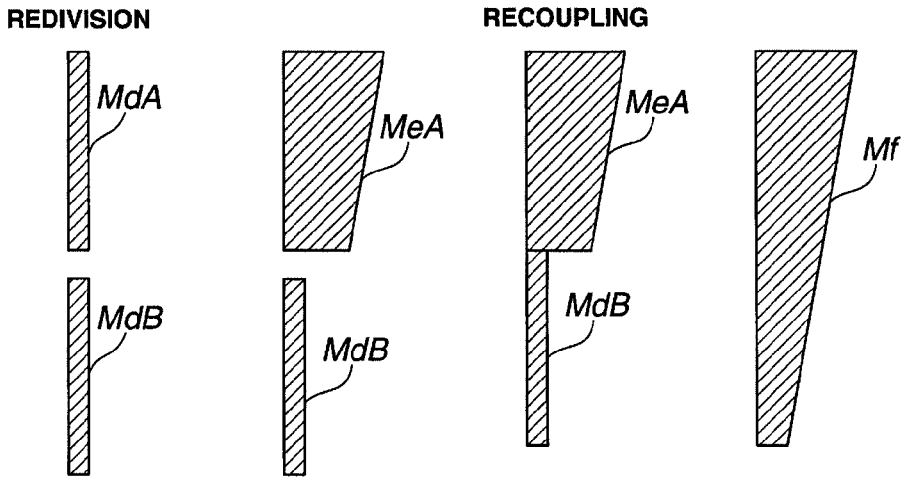

(9) The ink roller group 6 is divided again into the upstream roller subgroup 6A and downstream roller subgroup 6B. As shown in FIG. 6F, the ink film thickness distribution Md of the ink roller group 6 is divided into a basic ink film thickness distribution MdA of the upstream roller subgroup 6A and a basic ink film thickness distribution MdB of the downstream roller subgroup 6B.

(10) It is confirmed that setting of the opening ratios in preliminary ink feed as the opening ratios of the ink fountain keys 4-1 to 4-n has been completed. Thereafter, the ink feed operation of the ink ductor roller 5 starts. The printing press rotates by a predetermined number of revolutions (number N3 of revolutions in the preliminary ink feed operation), forming an ink film thickness distribution MeA in preliminary ink feed in the upstream roller subgroup 6A (FIG. 6G).

(11) The modified opening ratios (opening ratios in printing after preliminary ink feed) obtained in step (4) are set as the opening ratios of the ink fountain keys 4-1 to 4-n.

(12) The upstream roller subgroup 6A and downstream roller subgroup 6B are coupled again and return to the single ink roller group 6 (FIG. 6H).

(13) The ink form rollers 6-1 and 6-4 are thrown on, a sheet is fed, and printing (test reprinting) starts.

In step (13), an ink film thickness distribution (ink film thickness distribution in final test reprinting) in printing using the printing plate 7 is formed while ink is consumed from the end of the ink roller group 6 during printing (during test reprinting). At this time, the ink film thickness distribution MdB in the downstream roller subgroup 6B becomes thinner than that during normal printing. Thus, ink flows from the upstream side to the downstream side faster than in normal printing. A corrected ink film thickness distribution Mf (FIG. 6I) is formed quickly in the ink roller group 6.

If the corrected ink film thickness distribution Mf is to be formed immediately from the state shown in FIG. 6E, a corrected ink amount is supplied without consuming ink from the end of the ink roller group 6. Therefore, the ink film thickness distribution becomes thick on the downstream side, and the density of a printing product becomes high. To decrease the density, many printing products need to be printed. To the contrary, by executing the steps in FIGS. 6F to 6H, the ink film thickness distribution can be prevented from becoming thick on the downstream side. In particular, the corrected film thickness distribution Mf can be obtained quickly as an ink film thickness distribution thin on the downstream side.

[Detailed Operation of Ink Supply Amount Control Apparatus]

The detailed operation of the ink supply amount control apparatus will be explained with reference to FIGS. 7A to 7S.

Figure 7A:
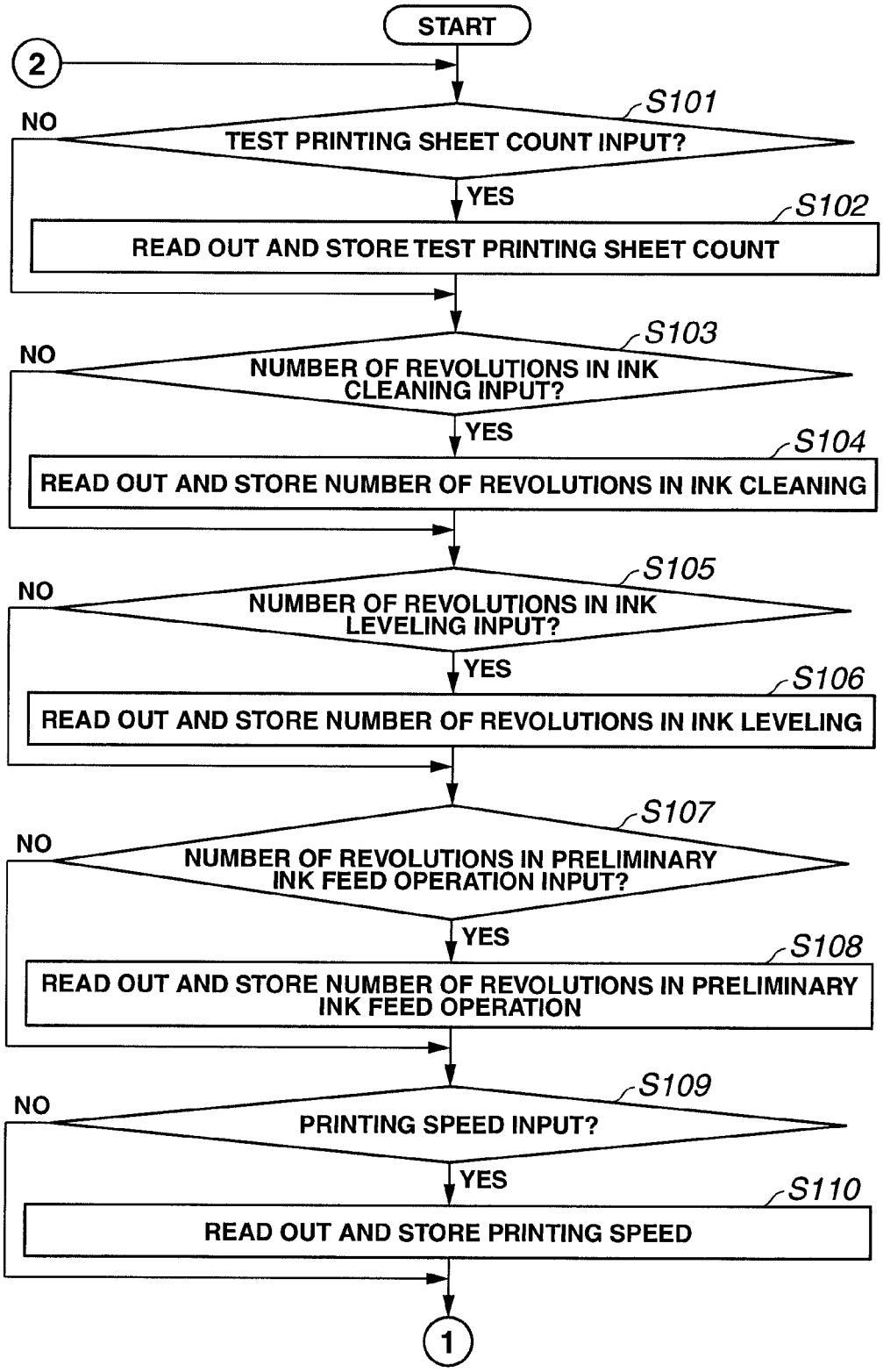
FIGS. 7A to 7S are flowcharts for explaining the detailed operation of the ink supply amount control apparatus shown in FIG. 1.

At the start of test printing, the operator inputs the test printing sheet count Px (FIG. 7A: step S101). In addition, the operator inputs the number N1 of revolutions in ink cleaning, the number N2 of revolutions in ink leveling, the number N3 of revolutions in the preliminary ink feed operation, and the printing speed Vp (steps S103, S105, S107, and S109).

In this case, the test printing sheet count Px is input from the sheet count setting unit 37. The number N1 of revolutions in ink cleaning is input from the number-of-revolutions setting unit 38. The number N2 of revolutions in ink leveling is input from the number-of-revolutions setting unit 39. The number N3 of revolutions in the preliminary ink feed operation is input from the number-of-revolutions setting unit 40. The printing speed Vp is input from the printing speed setting unit 41.

The CPU 10 stores, in the memory M1, the test printing sheet count Px which has been input from the sheet count setting unit 37 (step S102). The CPU 10 stores, in the memory M2, the number N1 of revolutions in ink cleaning which has been input from the number-of-revolutions setting unit 38 (step S104). The CPU 10 stores, in the memory M3, the number N2 of revolutions which has been input from the number-of-revolutions setting unit 39 (step S106). The CPU 10 stores, in the memory M4, the number N3 of revolutions in the preliminary ink feed operation which has been input from the number-of-revolutions setting unit 40 (step S108). The CPU 10 stores, in the memory M5, the printing speed Vp which has been input from the printing speed setting unit 41 (step S110).

The CPU 10 stores, in the memory M7, the image area ratios of ranges corresponding to the ink fountain keys 4-1 to 4-n on the printing plate 7 that have been input from the input device 13. In the embodiment, the image area ratios of the ranges corresponding to the ink fountain keys 4-1 to 4-n on the printing plate 7 are measured using an image area ratio measurement apparatus as disclosed in Japanese Patent Laid-Open No. 58-201008 (literature 3) or Japanese Patent Laid-Open No. 58-201010 (literature 4). Image area ratios measured using the image area ratio measurement apparatus are written in a portable memory. The portable memory in which the image area ratios are written is set in the input device 13, inputting the image area ratios of the ranges corresponding to the ink fountain keys 4-1 to 4-n on the printing plate 7. Note that the CPU 10 and the image area ratio measurement apparatus may be connected online to directly receive, from the image area ratio measurement apparatus, the image area ratios of the ranges corresponding to the ink fountain keys 4-1 to 4-n on the printing plate 7.

Figure 7B:
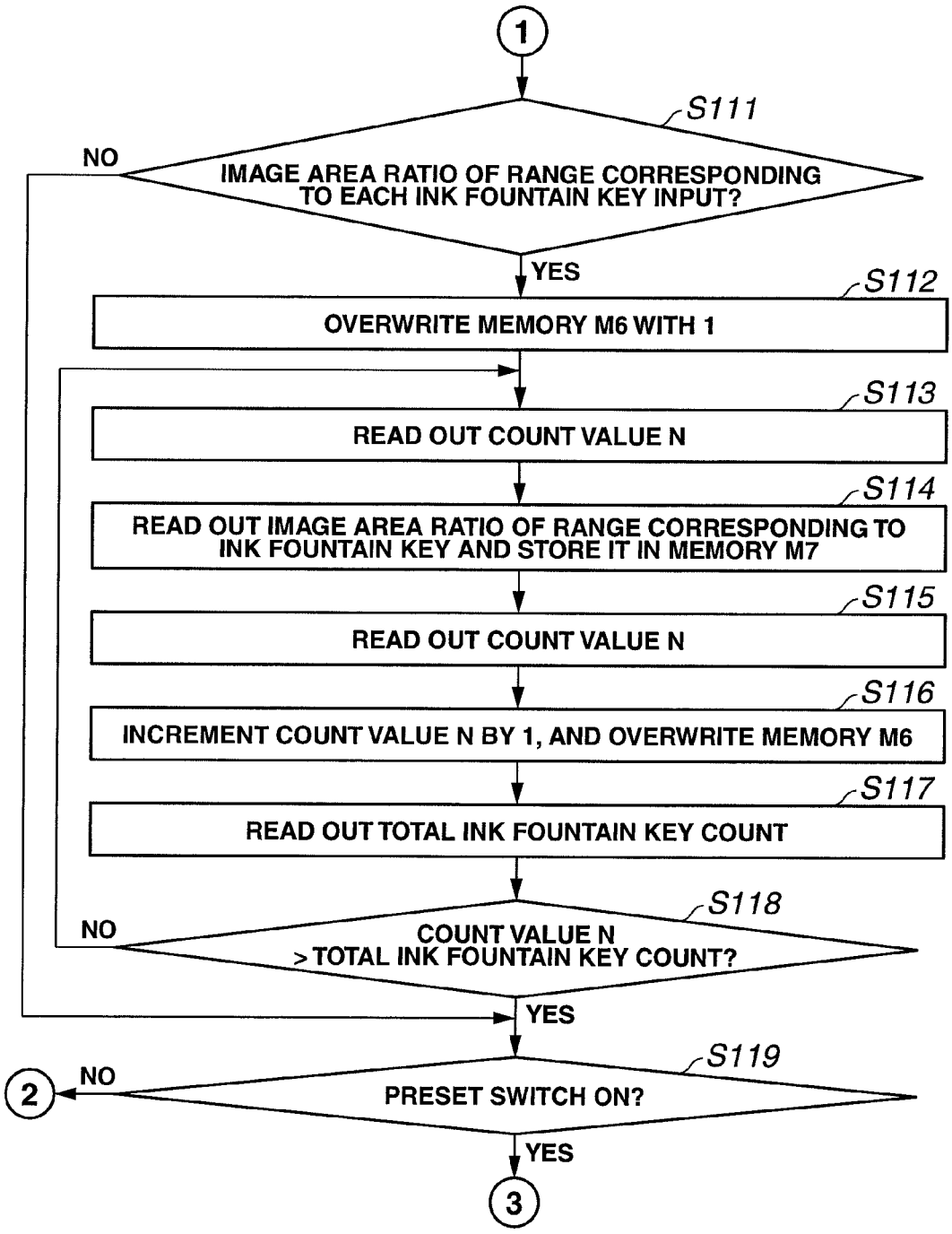

If the portable memory is set in the input device 13, that is, the image area ratios of the ranges corresponding to the ink fountain keys 4-1 to 4-n are input (FIG. 7B: YES in step S111), the CPU 10 overwrites the count value N in the memory M6 with N=1 (step S112), and reads out the count value N from the memory M6 (step S113). The CPU 10 reads out the image area ratio of a range corresponding to the Nth ink fountain key from the portable memory, and stores it at an address position for the Nth ink fountain key in the memory M7 (step S114).

The CPU 10 reads out the count value N from the memory M6 (step S115), increments the count value N by one, and overwrites the memory M6 with it (step S116). The CPU 10 reads out the total ink fountain key count n from the memory M8 (step S117). The CPU 10 repeats the processing operations in steps S113 to S118 until the count value N exceeds the total ink fountain key count n (YES in step S118). As a result, the image area ratios of the respective regions corresponding to the ink fountain keys 4-1 to 4-n on the printing plate 7 are read out from the portable memory, and stored in the memory M7.

[Setting of Opening Ratio of Ink Fountain Key]

Figure 7C:
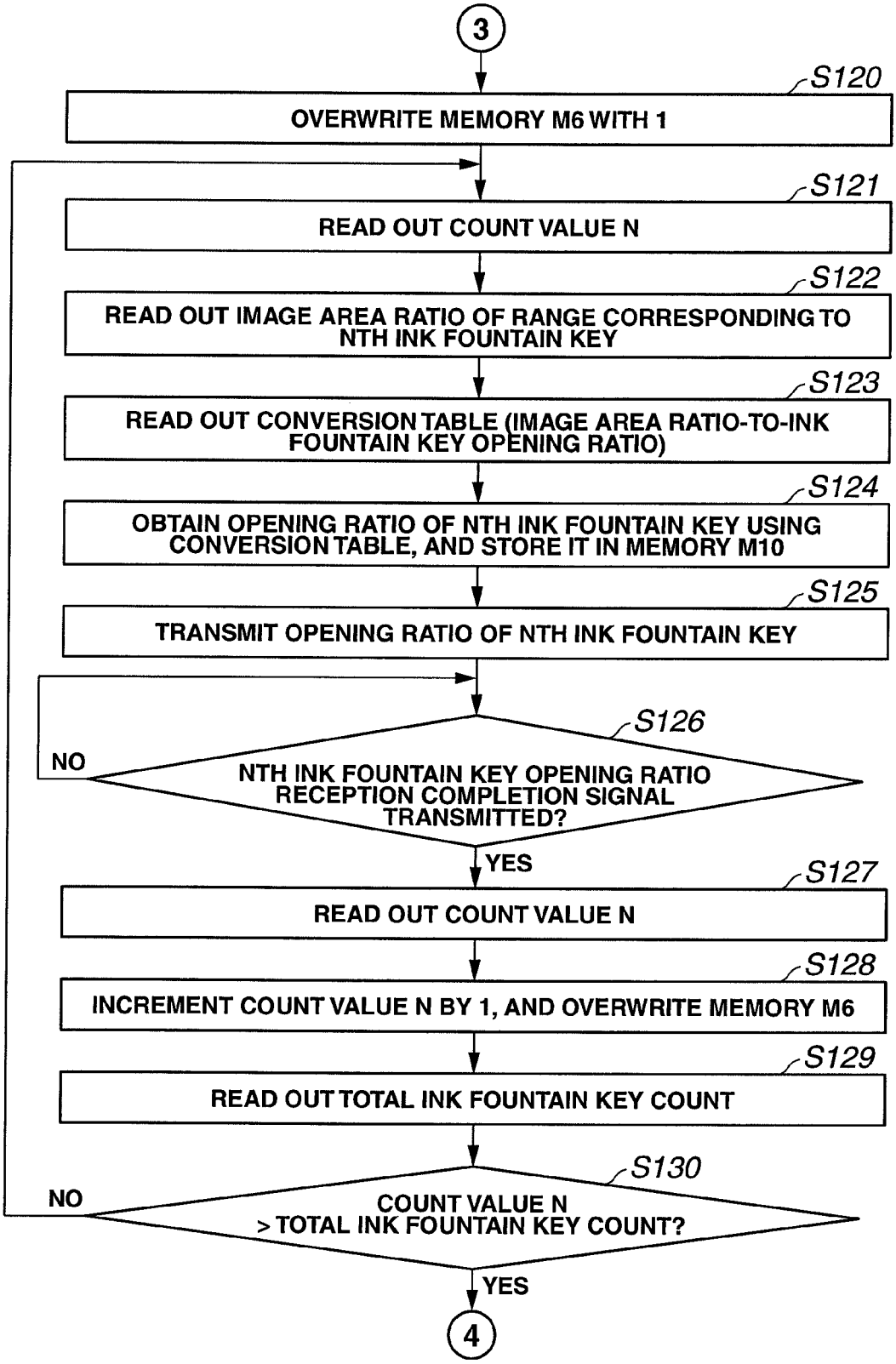

The operator turns on the preset start switch 16. If the preset switch 16 has been turned on (YES in step S119), the CPU 10 overwrites the count value N in the memory M6 with N=1 (FIG. 7C: step S120). The CPU 10 reads out the count value N from the memory M6 (step S121), and reads out the image area ratio of the range corresponding to the Nth ink fountain key from the address position for the Nth ink fountain key in the memory M7 (step S122).

The CPU 10 reads out the image area ratio-to-ink fountain key opening ratio conversion table from the memory M9 (step S123). By using the readout conversion table, the CPU 10 obtains the opening ratio of the Nth ink fountain key from the image area ratio of the range corresponding to the Nth ink fountain key. The CPU 10 stores the obtained opening ratio of the Nth ink fountain key at an address position for the Nth ink fountain key in the memory M10 (step S124), and transmits it to the Nth ink fountain key control apparatus 300 (step S125).

The CPU 10 confirms that the Nth ink fountain key control apparatus 300 has transmitted an Nth ink fountain key opening ratio reception completion signal (YES in step S126). Then, the CPU 10 reads out the count value N from the memory M6 (step S127), increments the count value N by one, and overwrites the memory M6 with it (step S128). The CPU 10 reads out the total ink fountain key count n from the memory M8 (step S129). The CPU 10 repeats the processing operations in steps S121 to S130 until the count value N exceeds the total ink fountain key count n (YES in step S130).

Accordingly, the opening ratios of the ink fountain keys 4-1 to 4-n that correspond to the image area ratios of the ranges corresponding to the ink fountain keys 4-1 to 4-n on the printing plate 7 are obtained, stored in the memory M10, and transmitted to the ink fountain key control apparatuses 300-1 to 300-n.

[Confirmation of Completion of Setting Opening Ratio of Ink Fountain Key]

Figure 7D:
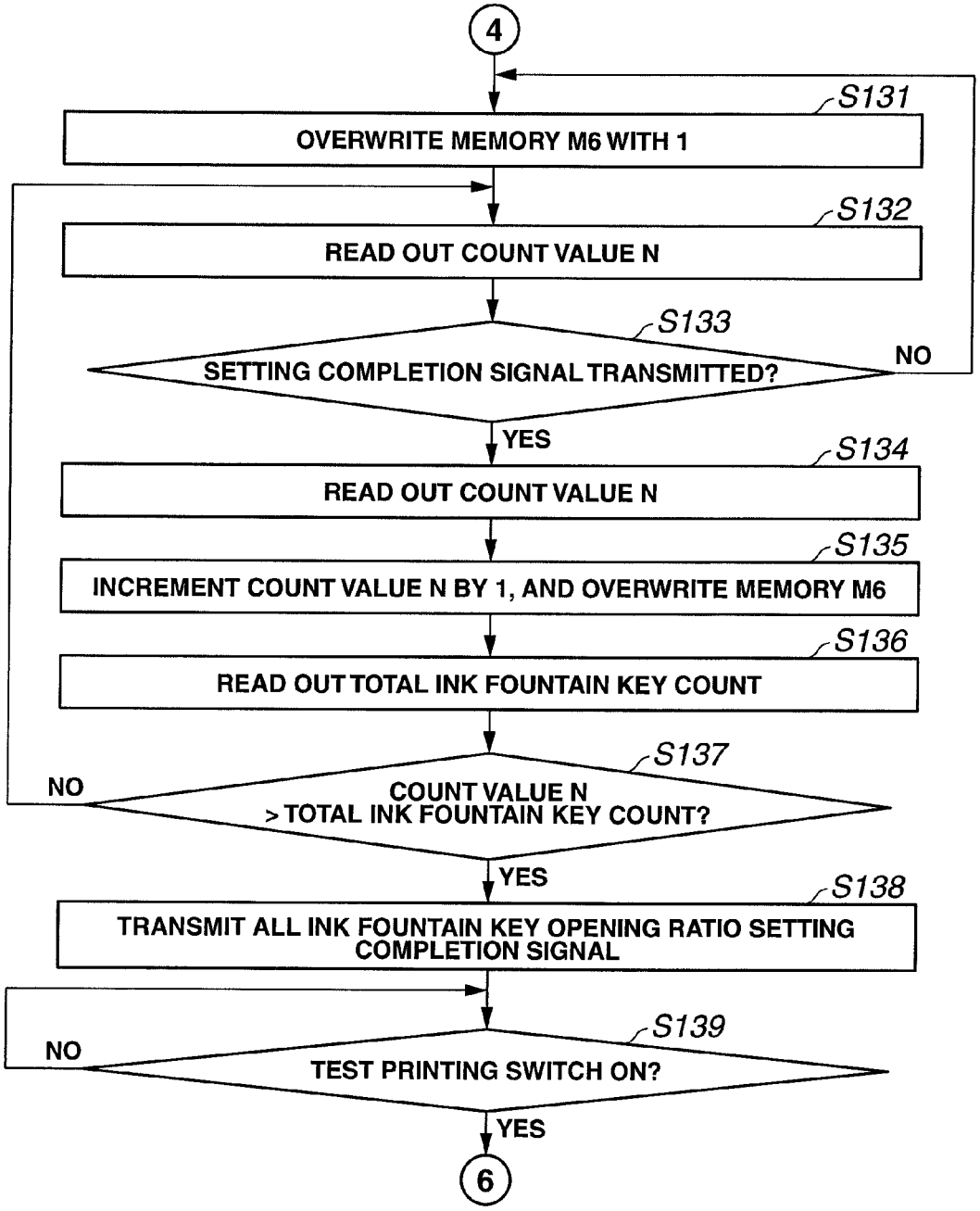

The CPU 10 overwrites the count value N in the memory M6 with N=1 (FIG. 7D: step S131), and reads out the count value N from the memory M6 (step S132). The CPU 10 confirms the presence/absence of an ink fountain key opening ratio setting completion signal from the Nth ink fountain key control apparatus 300 (step S133).

If the CPU 10 confirms that the Nth ink fountain key control apparatus 300 has transmitted the ink fountain key opening ratio setting completion signal (YES in step S133), it reads out the count value N from the memory M6 (step S134). The CPU 10 increments the count value N by one, and overwrites the memory M6 with it (step S135). The CPU 10 reads out the total ink fountain key count n from the memory M8 (step S136). The CPU 10 repeats the processing operations in steps S132 to S137 until the count value N exceeds the total ink fountain key count n (YES in step S137).

If the count value N exceeds the total ink fountain key count n (YES in step S137), the CPU 10 determines that the setting of the opening ratios of the ink fountain keys has been completed. The CPU 10 transmits an all ink fountain key opening ratio setting completion signal to all the ink fountain key control apparatuses 300 (300-1 to 300-n) (step S138).

[Test Printing]

The operator turns on the test printing switch 17. If the test printing switch 17 has been turned on (YES in step S139), the CPU 10 starts test printing processing.

Figure 7E:
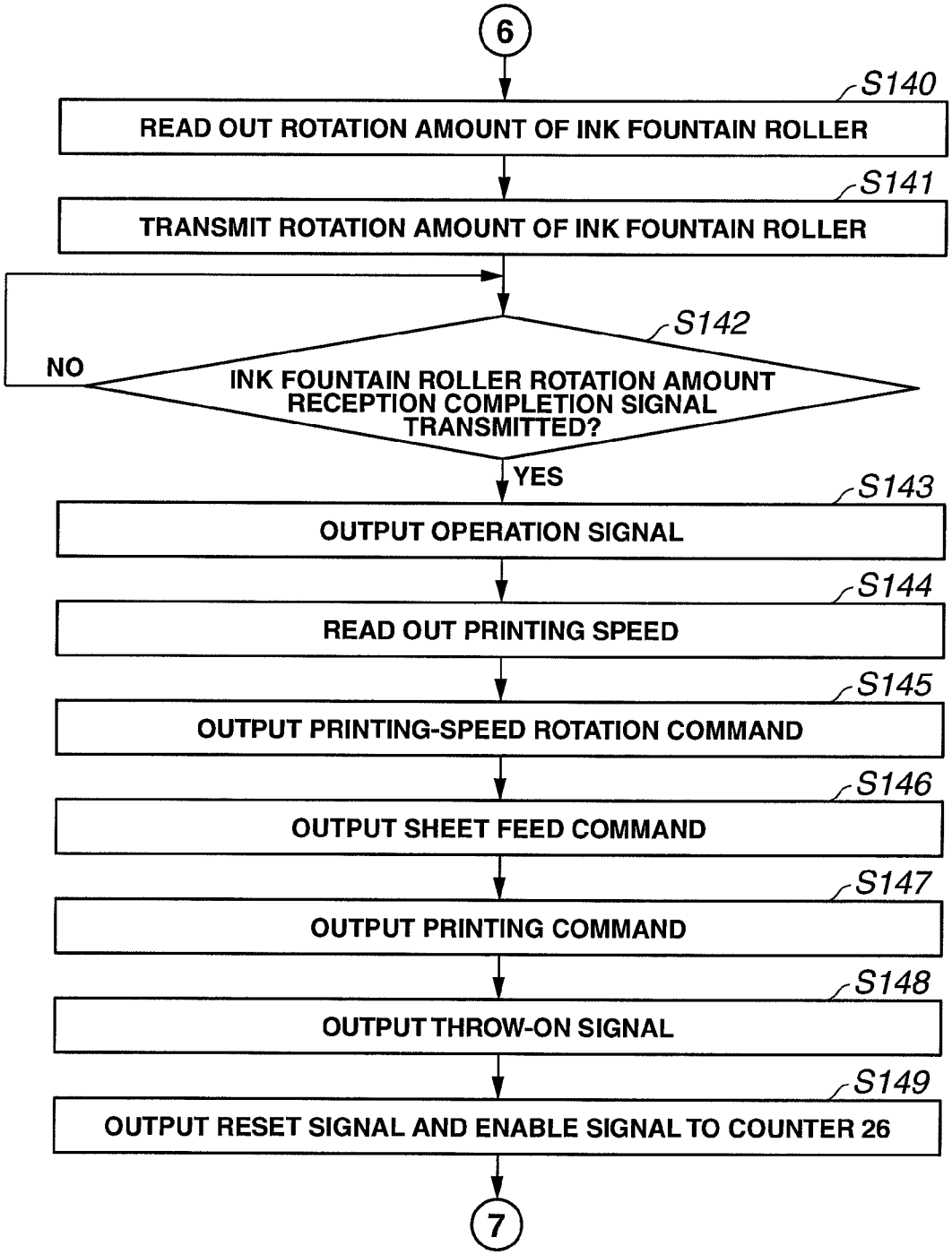

In the test printing processing, the CPU 10 reads out the rotation amount of the ink fountain roller that is stored in the memory M11 (FIG. 7E: step S140). The CPU 10 transmits the readout rotation amount of the ink fountain roller to the ink fountain roller control apparatus 200 (step S141). If the CPU 10 receives an ink fountain roller rotation amount reception completion signal from the ink fountain roller control apparatus 200 (YES in step S142), it outputs an operation signal to the ink ductor device 27 (step S143), and starts the ink feed operation of the ink ductor roller 5.

The CPU 10 reads out the printing speed Vp from the memory M5 (step S144), outputs a rotation command to the drive motor driver 22 via the D/A converter 24 (step S145), and sets the printing speed Vp as the speed of the printing press. The CPU 10 outputs a sheet feed command to the sheet feeder 33 (step S146) to start sheet feed to the printing press. The CPU 10 outputs a printing command to the printing unit 34 (step S147). Further, the CPU 10 outputs a throw-on signal to the ink form roller throw-on/off pneumatic cylinder valve 36 (step S148) to throw on the ink form rollers 6-1 to 6-4. The CPU 10 starts printing (test printing) using the printing plate 7.

Figure 7F:
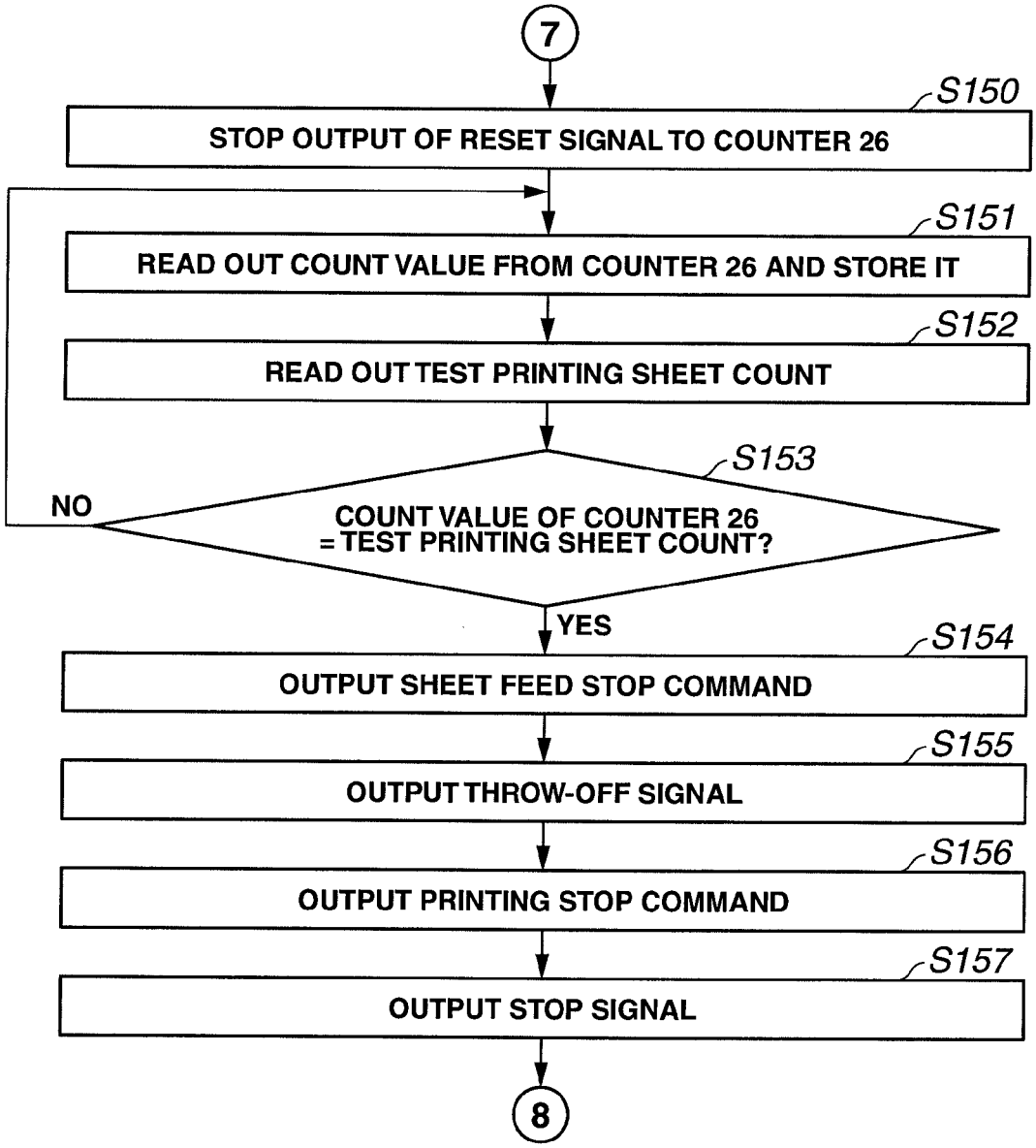

The CPU 10 continues the test printing until the number of revolutions of the printing press reaches the test printing sheet count Px in the memory M1. More specifically, the CPU 10 outputs a throw-on signal to the valve 36 (step S148), and outputs a reset signal and enable signal to the counter 26 (step S149). The CPU 10 then stops the output of the reset signal to the counter 26 (FIG. 7F: step S150), and starts the count operation of the counter 26 from 0. The CPU 10 reads out the count value of the counter 26, and stores it in the memory M12 (step S151). The CPU 10 reads out the test printing sheet count Px from the memory M1 (step S152). The CPU 10 repeats the processing operations in steps S151 to S153 until the count value of the counter 26 reaches the test printing sheet count Px (YES in step S153).

If the count value of the counter 26 reaches the test printing sheet count Px (YES in step S153), the CPU 10 outputs a sheet feed stop command to the sheet feeder 33 to stop sheet feed (step S154). The CPU 10 outputs a throw-off signal to the valve 36 (step S155) to throw off the ink form rollers 6-1 to 6-4. The CPU 10 outputs a printing stop command to the printing unit 34 (step S156), and outputs a stop command to the drive motor driver 22 (step S157) to stop the printing press.

In this case, the ink film thickness distribution Mc corresponding to an image on the printing plate 7 remains in the ink roller group 6, as shown in FIG. 6A. That is, the ink film thickness distribution Mc during test printing remains.

[Density Measurement]

The operator extracts one of printing products after printing, and sets it as a test printing sample 9 on the measurement table 53-4 (FIG. 5). In this setting state, a color bar 9-2 of the test printing sample 9 is positioned below the head 43-1 of the colorimeter 43.

In this state, the operator turns on the density measurement switch 18. If the density measurement switch 18 has been turned on (FIG. 7G: YES in step S158), the CPU 10 starts density measurement processing. FIGS. 7H to 7J show the flowcharts of the density measurement processing.

[Color Data Sampling]

In the density measurement processing, the CPU 10 outputs a forward rotation signal to the motor driver 46 to rotate the motor 44 forward (FIG. 7H: step S159). Along with the forward rotation of the motor 44, the ball screw 53-3 rotates forward. The colorimeter 43 is guided by the ball screw 53-3, and moves from the home position in contact with the column 53-1 toward the column 53-2.

The CPU 10 overwrites the count value N in the memory M6 with N=1 (step S160). The CPU 10 reads out the count value of the counter 47, and stores it in the memory M13 (step S161). The CPU 10 calculates the current position of the colorimeter 43 from the readout count value, and stores it in the memory M14 (step S162). The CPU 10 reads out the count value N from the memory M6 (step S163), and reads out the Nth patch position of the test printing sample to be measured from the memory M15 (step S164). If the current position of the colorimeter 43 reaches the readout Nth patch position (YES in step S165), the CPU 10 outputs a measurement command signal to the colorimeter 43 (step S166). The colorimeter 43 samples, via the A/D converter 48, color data of the patch 9*a* of the test printing sample 9 that is positioned at the Nth patch position. The CPU 10 stores the sampled color data at an address position for the Nth ink fountain key in the memory M16 (FIG. 7I: steps S167 and S168).

The CPU 10 reads out the count value N from the memory M6 (step S169), increments the count value N by one, and overwrites the memory M6 with it (step S170). The CPU 10 reads out the total ink fountain key count n from the memory M8 (step S171). The CPU 10 repeats the processing operations in steps S161 to S172 until the count value N exceeds the total ink fountain key count n (YES in step S172). Every time the current position of the colorimeter 43 reaches the Nth patch position stored in the memory M15, the colorimeter 43 samples color data of the patch 9*a* of the test printing sample 9 that is positioned at the Nth patch position. The sampled color data is stored in the memory M16.

Upon completion of sampling color data from the test printing sample 9 (YES in step S172), the CPU 10 stops the forward rotation of the motor 44 (step S173). Then, the CPU 10 rotates the motor 44 reversely (step S174). If an output from the colorimeter home position detector 49 is enabled (YES in step S175) and the colorimeter 43 returns to the home position, the CPU 10 stops the reverse rotation of the motor 44 (step S176).

[Density Difference Calculation]

The CPU 10 overwrites the count value N in the memory M6 with N=1 (FIG. 7J: step S178), and reads out the count value N from the memory M6 (step S179). The CPU 10 reads out color data corresponding to the Nth ink fountain key from the address position for the Nth ink fountain key in the memory M16 (step S180). The CPU 10 calculates, from the readout color data, the density value of a patch corresponding to the Nth ink fountain key on the test printing sample 9, and stores it at an address position for the Nth ink fountain key in the memory M17 (step S181).

The CPU 10 reads out a reference density value from the memory M18 (step S182). The CPU 10 subtracts the reference density value from the density value of the patch corresponding to the Nth ink fountain key, and stores the subtraction result as the measured density difference of the patch corresponding to the Nth ink fountain key on the test printing sample 9 at an address position for the Nth ink fountain key in the memory M19 (step S183). The CPU 10 displays the measured density on the display unit 14 (step S184).

The CPU 10 reads out the count value N from the memory M6 (step S185), increments the count value N by one, and overwrites the memory M6 with it (step S186). The CPU 10 reads out the total ink fountain key count n from the memory M8 (step S187). The CPU 10 repeats the processing operations in steps S179 to S188 until the count value N exceeds the total ink fountain key count n (YES in step S188). Accordingly, the measured density differences of patches corresponding to the ink fountain keys 4-1 to 4-n on the test printing sample 9 are stored in the memory M19.

Note that the embodiment adopts a spectrometer as the colorimeter 43. An output value of each wavelength from the spectrometer is multiplied by the transmittance of each wavelength of a filter used to measure a solid patch of each color by a densitometer. The resultant output values are added, obtaining a density value of each color.

[Density Modification]

The operator turns on the density modification switch 19. If the density modification switch 19 has been turned on (FIG. 7G: YES in step S189), the CPU 10 starts density modification processing. FIGS. 7K to 7S show the flowcharts of the density modification processing.

[Calculation of Opening Ratio of Ink Fountain Key in Preliminary Ink Feed and Modified Opening Ratio (Opening Ratio in Printing after Preliminary Ink Feed)]

If the density modification switch 19 is turned on (YES in step S189), the CPU 10 overwrites the count value N in the memory M6 with N=1 (FIG. 7K: step S190), and reads out the count value N from the memory M6 (step S191). The CPU 10 reads out, as $\Delta D_N$ from the memory M19, the measured density difference of a patch corresponding to the Nth ink fountain key on the test printing sample 9 (step S192). The CPU 10 reads out, as $S_N$ from the memory M7, the image area ratio of a range corresponding to the Nth ink fountain key (step S193). The CPU 10 calculates the opening ratio $\theta_N'$ of the Nth ink fountain key in preliminary ink feed using equation (1):

$$\theta_N' = \alpha \cdot \Delta D_N \cdot S_N \cdot \beta \quad (1)$$

The CPU 10 stores the opening ratio $\theta_N'$ at an address position for the Nth ink fountain key in the memory M20 (step S194). Also, the CPU 10 calculates the modified opening ratio (opening ratio in printing after preliminary ink feed) $\theta_N''$ of the Nth ink fountain key using equation (2):

$$\theta_N'' = S_N - \alpha \cdot \Delta D_N \cdot S_N \quad (2)$$

The CPU 10 stores the modified opening ratio $\theta_N''$ at an address position for the Nth ink fountain key in the memory M21 (step S195).

In equations (1) and (2), $\alpha$ is a predetermined correction coefficient. In equation (1), $\beta$ is a correction coefficient obtained by dividing the current rotation amount of the ink fountain roller 3 by the reference rotation amount of the ink fountain roller 3.

[Setting to Opening Ratio of Ink Fountain Key in Preliminary Ink Feed]

The CPU 10 transmits the opening ratio $\theta_N'$ of the Nth ink fountain key in preliminary ink feed to the Nth ink fountain key control apparatus 300 (step S196). If the CPU 10 receives an Nth ink fountain key opening ratio reception completion signal from the Nth ink fountain key control apparatus 300 (YES in step S197), it reads out the count value N from the memory M6 (step S198). The CPU 10 increments the count value N by one, and overwrites the memory M6 with it (step S199). The CPU 10 reads out the total ink fountain key count n from the memory M8 (step S200). The CPU 10 repeats the processing operations in steps S191 to S201 until the count value N exceeds the total ink fountain key count n (YES in step S201).

As a result, the memory M20 stores the opening ratios $\theta_1'$ to $\theta n'$ of the ink fountain keys 4-1 to 4-n in preliminary ink feed. The memory M21 stores the modified opening ratios (opening ratios in printing after preliminary ink feed) $\theta_1''$ to $\theta n''$ of the ink fountain keys 4-1 to 4-n. The opening ratios $\theta_1'$ to $\theta n'$ in preliminary ink feed are transmitted to the ink fountain key control apparatuses 300-1 to 300-n.

[Division of Ink Roller Group]

Figure 3:
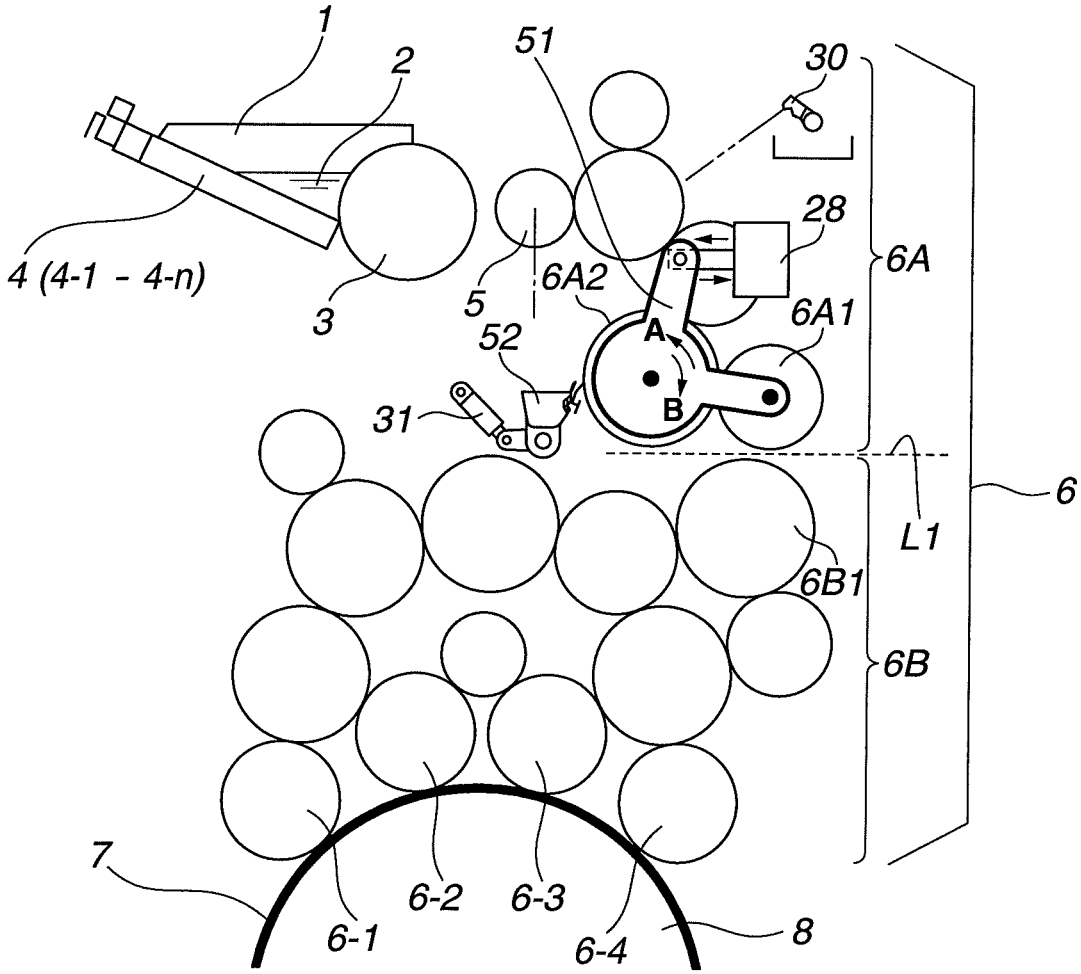
FIG. 3 is a view showing the main part (state in which the ink roller group is divided) of the ink supply apparatus to be controlled by the ink supply amount control apparatus shown in FIG. 1.

The CPU 10 outputs an operation stop signal to the ink ductor device 27 (FIG. 7L: step S202) to stop the ink feed operation of the ink ductor roller 5. Note that the throw-off operation of the ink form rollers 6-1 to 6-4 (step S155) by the CPU 10, and the stop of the ink feed operation of the ink ductor roller 5 (step S202) constitute a step/means for disconnecting the ink roller group 6 from the ink supply path. Thereafter, the CPU 10 outputs a division signal to the valve 29 (step S203) to divide the ink roller group 6 into the upstream roller subgroup 6A and downstream roller subgroup 6B, as shown in FIG. 3.

As shown in FIG. 6B, the ink film thickness distribution Mc of the ink roller group 6 is divided into the ink film thickness distribution McA of the upstream roller subgroup 6A and the ink film thickness distribution McB of the downstream roller subgroup 6B.

[Cleaning of Ink in Upstream Roller Subgroup]

The CPU 10 outputs an 8000-rph rotation command to the motor driver 22 via the D/A converter 24 (step S204). In response to this, the printing press starts rotating, and its speed rises up to 8,000 rph. The CPU 10 outputs a solvent supply command to the solvent supply device 30 (step S205), and outputs a throw-on signal to the valve 32 (step S206). The solvent supply device 30 injects a solvent, and the doctor 52 comes into contact with the outer surface of the roller 6A2, starting cleaning of ink in the upstream roller subgroup 6A.

The CPU 10 keeps cleaning the ink in the upstream roller subgroup 6A until the number of revolutions of the printing press reaches the number N1 of revolutions in ink cleaning in the memory M2. More specifically, the CPU 10 outputs a throw-on signal to the valve 32 (step S206), and outputs a reset signal and enable signal to the counter 26 for counting the number of revolutions of the printing press (step S207). The CPU 10 then stops the output of the reset signal to the counter 26 (step S208), and starts the count operation of the counter 26 from 0. The CPU 10 reads out the count value of the counter 26, and stores it in the memory M12 (step S209). The CPU 10 reads out the number N1 of revolutions in ink cleaning from the memory M2 (step S210). The CPU 10 repeats the processing operations in steps S209 to S211 until the count value of the counter 26 reaches the number N1 of revolutions in ink cleaning (YES in step S211).

Figure 7G:
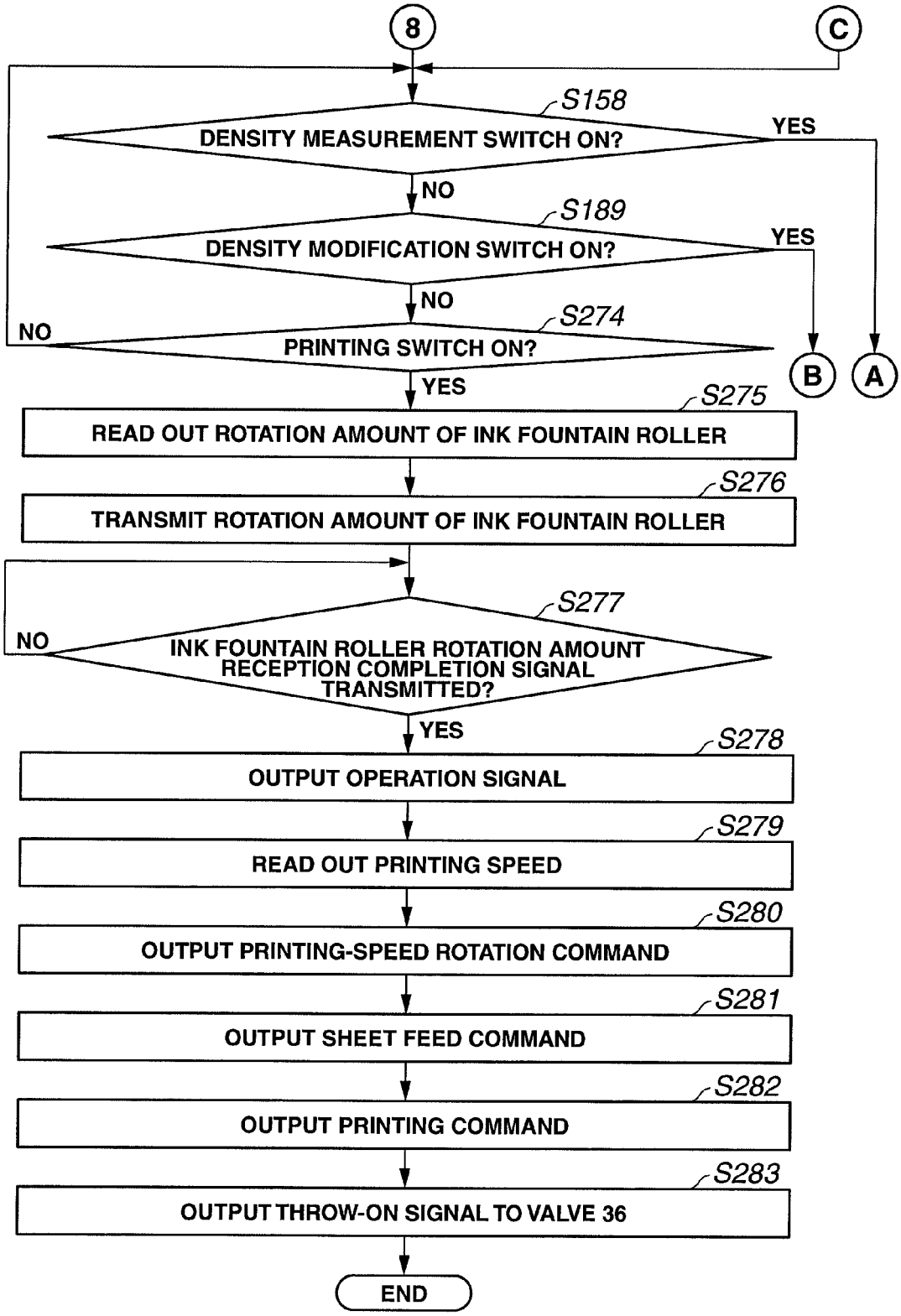
Figure 7H:
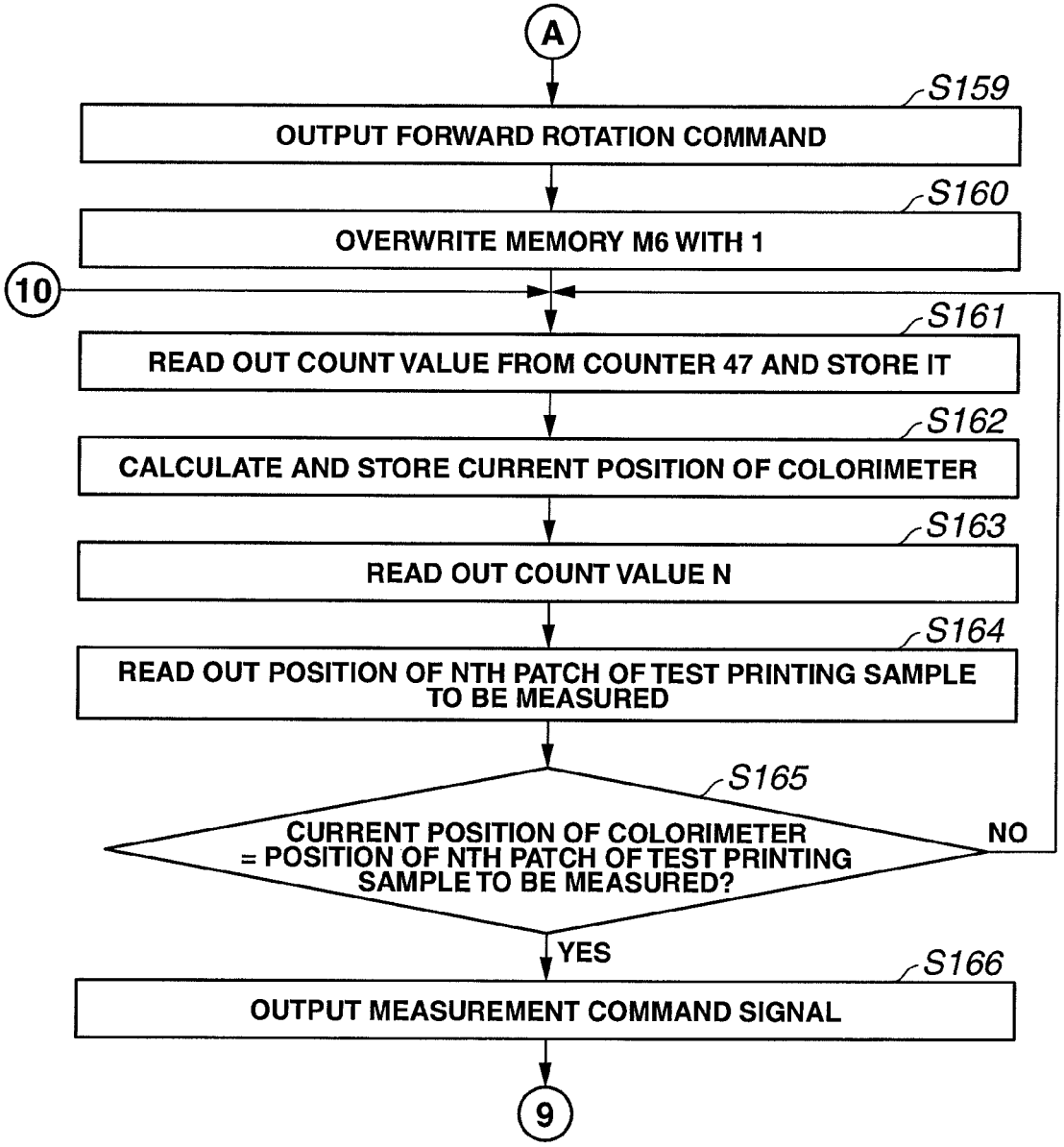
Figure 7I:
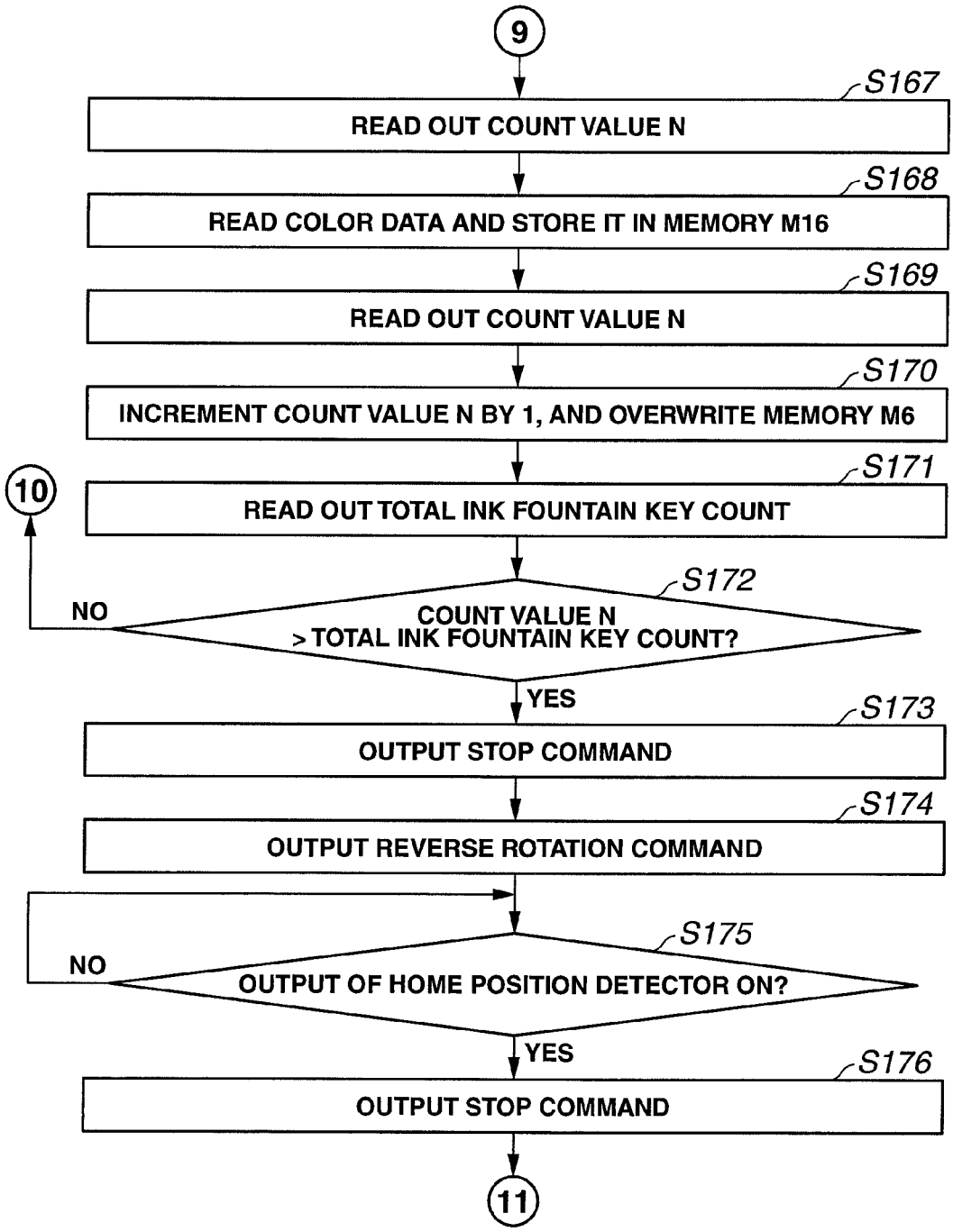
Figure 7J:
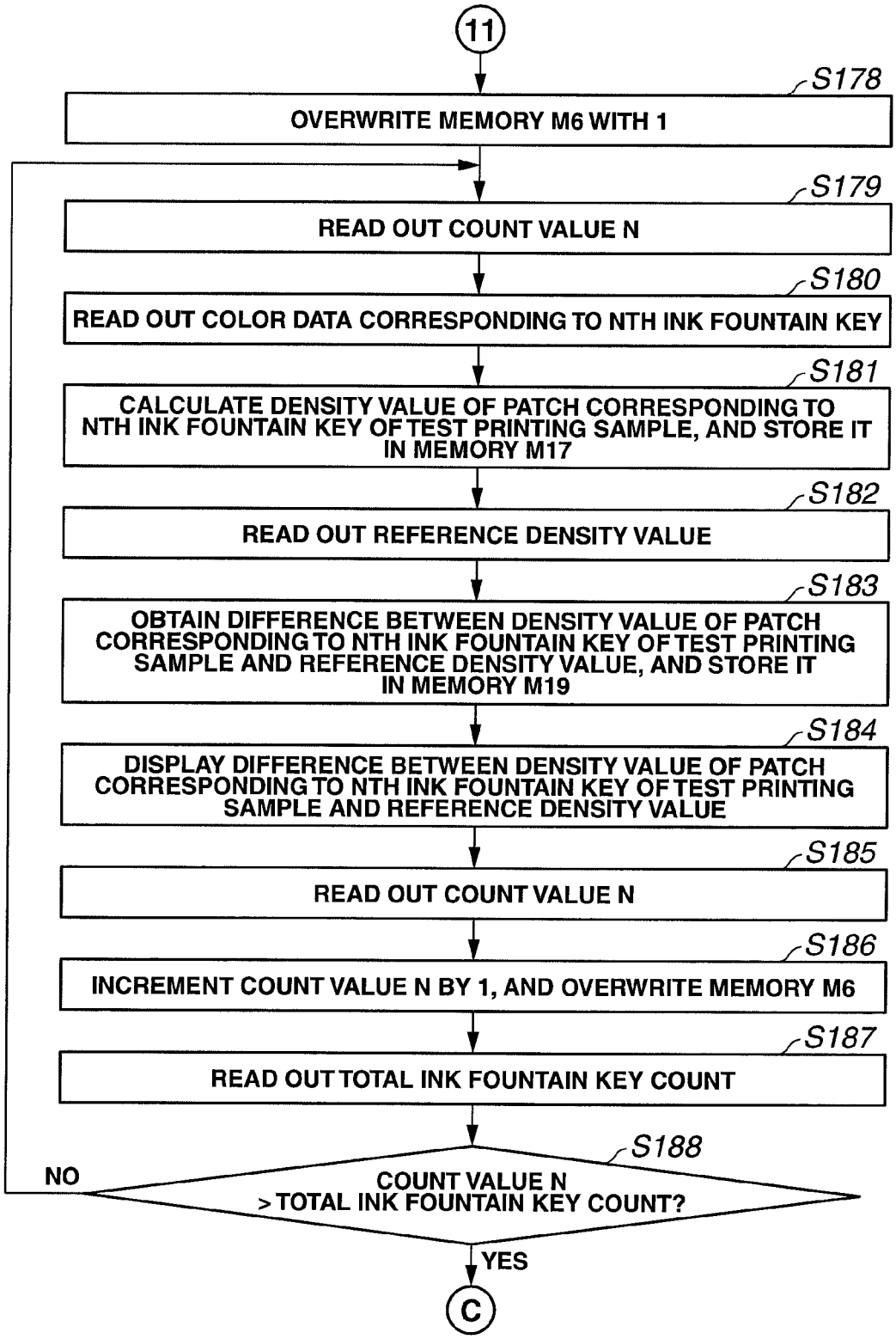
Figure 7K:
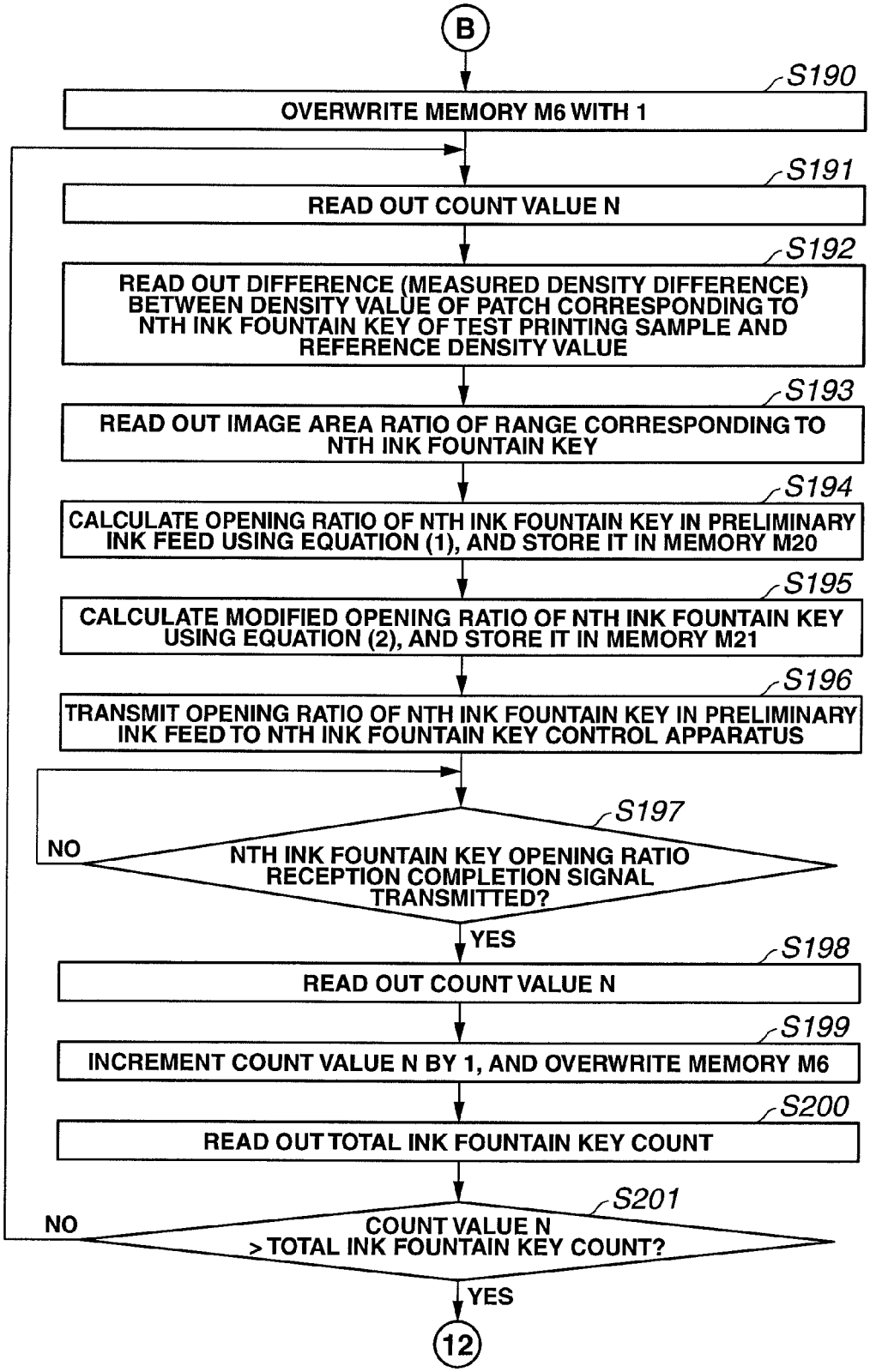
Figure 7L:
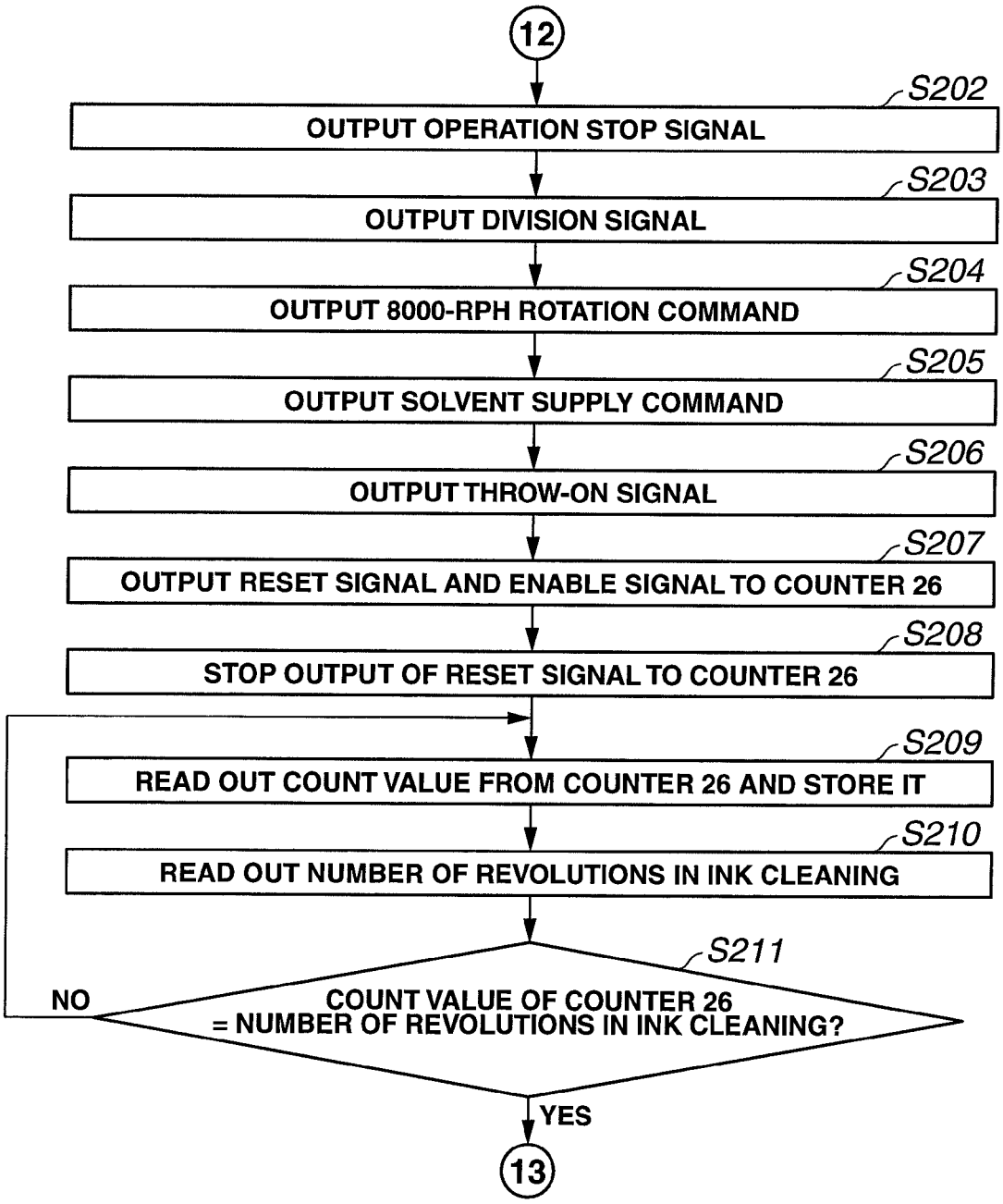
Figure 7M:
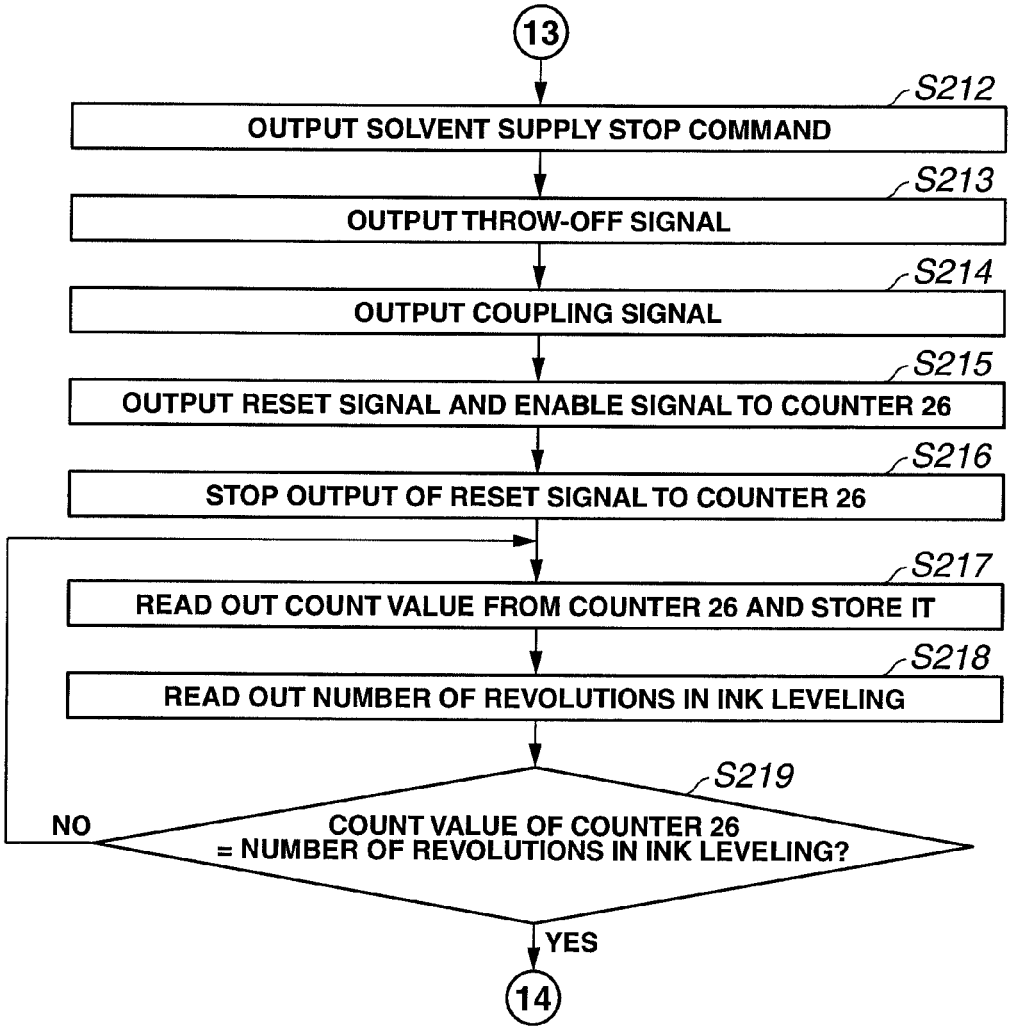
Figure 7N:
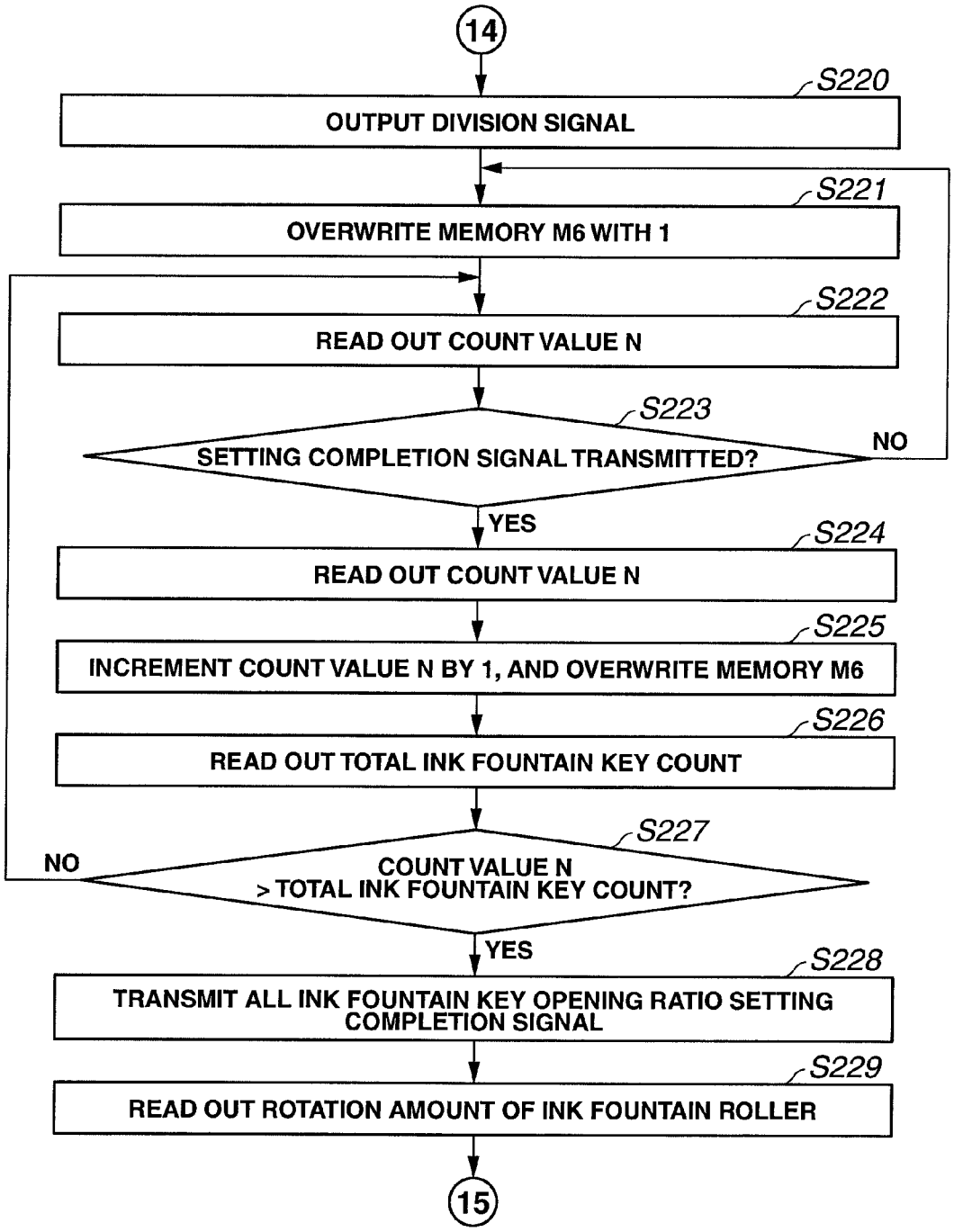

If the count value of the counter 26 reaches the number N1 of revolutions in ink cleaning (YES in step S211), the CPU 10 outputs a solvent supply stop command to the solvent supply device 30 (FIG. 7M: step S212). The CPU 10 outputs a throw-off signal to the valve 32 (step S213), completing the cleaning of the ink in the upstream roller subgroup 6A.

As shown in FIG. 6C, the ink film thickness distribution McA of the upstream roller subgroup 6A becomes almost 0. At this time, the ink film thickness distribution of the downstream roller subgroup 6B is leveled by the number N1 of revolutions in ink cleaning, obtaining the flat ink film thickness distribution McB'.

[Coupling of Ink Roller Group]

The CPU 10 outputs a coupling signal to the valve 29 (step S214) to couple the upstream roller subgroup 6A and downstream roller subgroup 6B, as shown in FIG. 2, and return them to the single ink roller group 6 (FIG. 6D).

The CPU 10 outputs a reset signal and enable signal to the counter 26 (step S215). Then, the CPU 10 stops the output of the reset signal to the counter 26 (step S216), and starts the count operation of the counter 26 from 0. The CPU 10 reads out the count value of the counter 26, and stores it in the memory M12 (step S217). The CPU 10 reads out the number N2 of revolutions in ink leveling from the memory M3 (step S218). The CPU 10 repeats the processing operations in steps S217 to S219 until the count value of the counter 26 reaches the number N2 of revolutions in ink leveling (YES in step S219).

Accordingly, the ink film thickness distribution McB' remaining in the downstream roller subgroup 6B is leveled between the downstream roller subgroup 6B and the upstream roller subgroup 6A, forming the thin, flat ink film thickness distribution (basic ink film thickness distribution) Md (FIG. 6E) in the ink roller group 6.

[Redivision of Ink Roller Group]

If the count value of the counter 26 reaches the number N2 of revolutions in ink leveling (YES in step S219), the CPU 10 outputs a division signal to the valve 29 (FIG. 7N: step S220) to divide again the ink roller group 6 into the upstream roller subgroup 6A and downstream roller subgroup 6B. As shown in FIG. 6F, the ink film thickness distribution Md of the ink roller group 6 is divided into the basic ink film thickness distribution MdA of the upstream roller subgroup 6A and the basic ink film thickness distribution MdB of the downstream roller subgroup 6B.

[Confirmation of Completion of Setting Opening Ratio of Ink Fountain Key]

The CPU 10 overwrites the count value N in the memory M6 with N=1 (step S221), and reads out the count value N from the memory M6 (step S222). The CPU 10 confirms the presence/absence of an ink fountain key opening ratio setting completion signal from the Nth ink fountain key control apparatus 300 (step S223).

If the CPU 10 confirms that the Nth ink fountain key control apparatus 300 has transmitted the ink fountain key opening ratio setting completion signal (YES in step S223), the CPU 10 reads out the count value N from the memory M6 (step S224). The CPU 10 increments the count value N by one, and overwrites the memory M6 with it (step S225). The CPU 10 reads out the total ink fountain key count n from the memory M8 (step S226). The CPU 10 repeats the processing operations in steps S222 to S227 until the count value N exceeds the total ink fountain key count n (YES in step S227).

If the count value N exceeds the total ink fountain key count n (YES in step S227), the CPU 10 determines that the setting of the opening ratios of the ink fountain keys has been completed. The CPU 10 transmits an all ink fountain key opening ratio setting completion signal to all the ink fountain key control apparatuses 300 (300-1 to 300-n) (step S228).

[Preliminary Ink Feed]

Figure 7O:
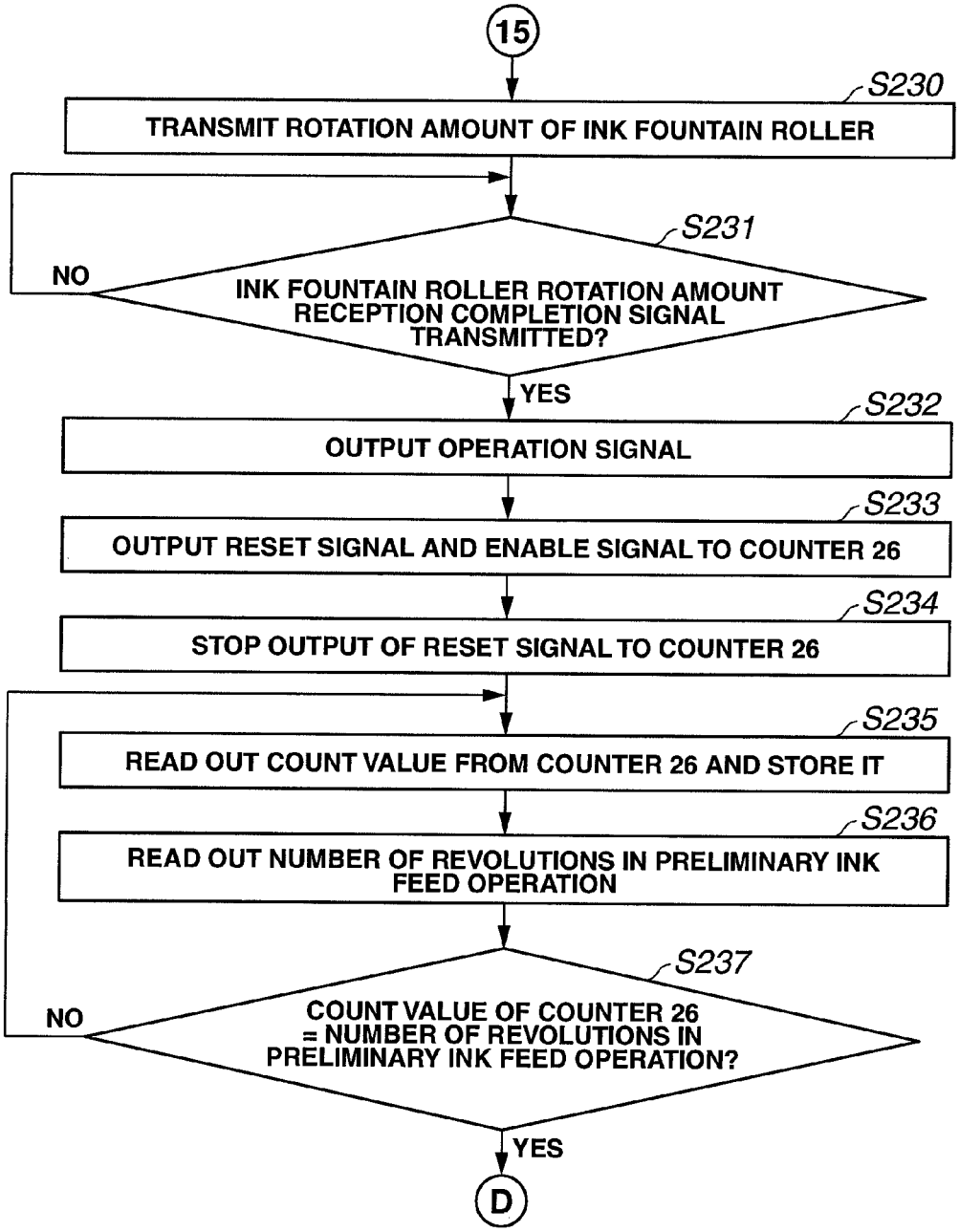
Figure 7P:
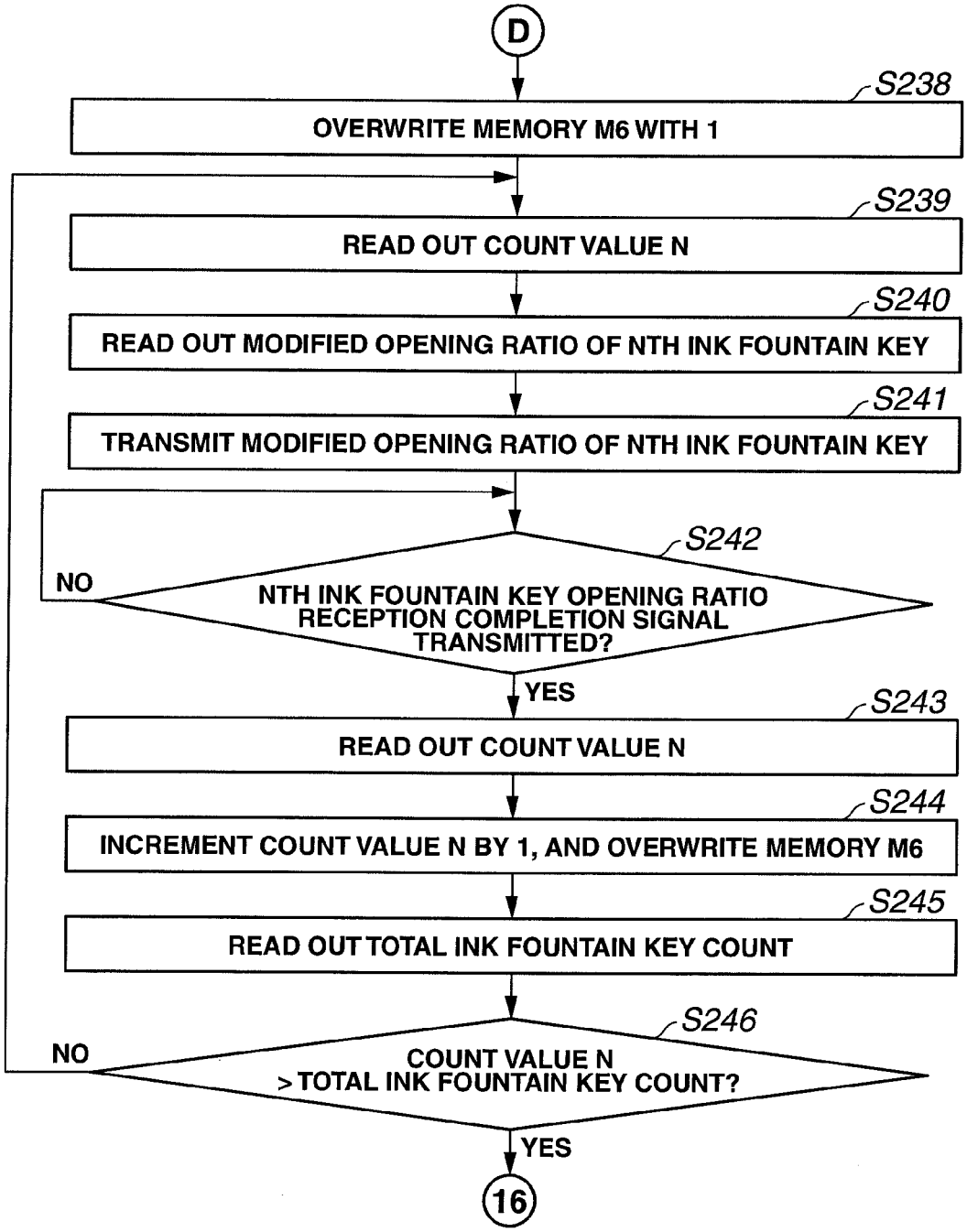
Figure 7Q:
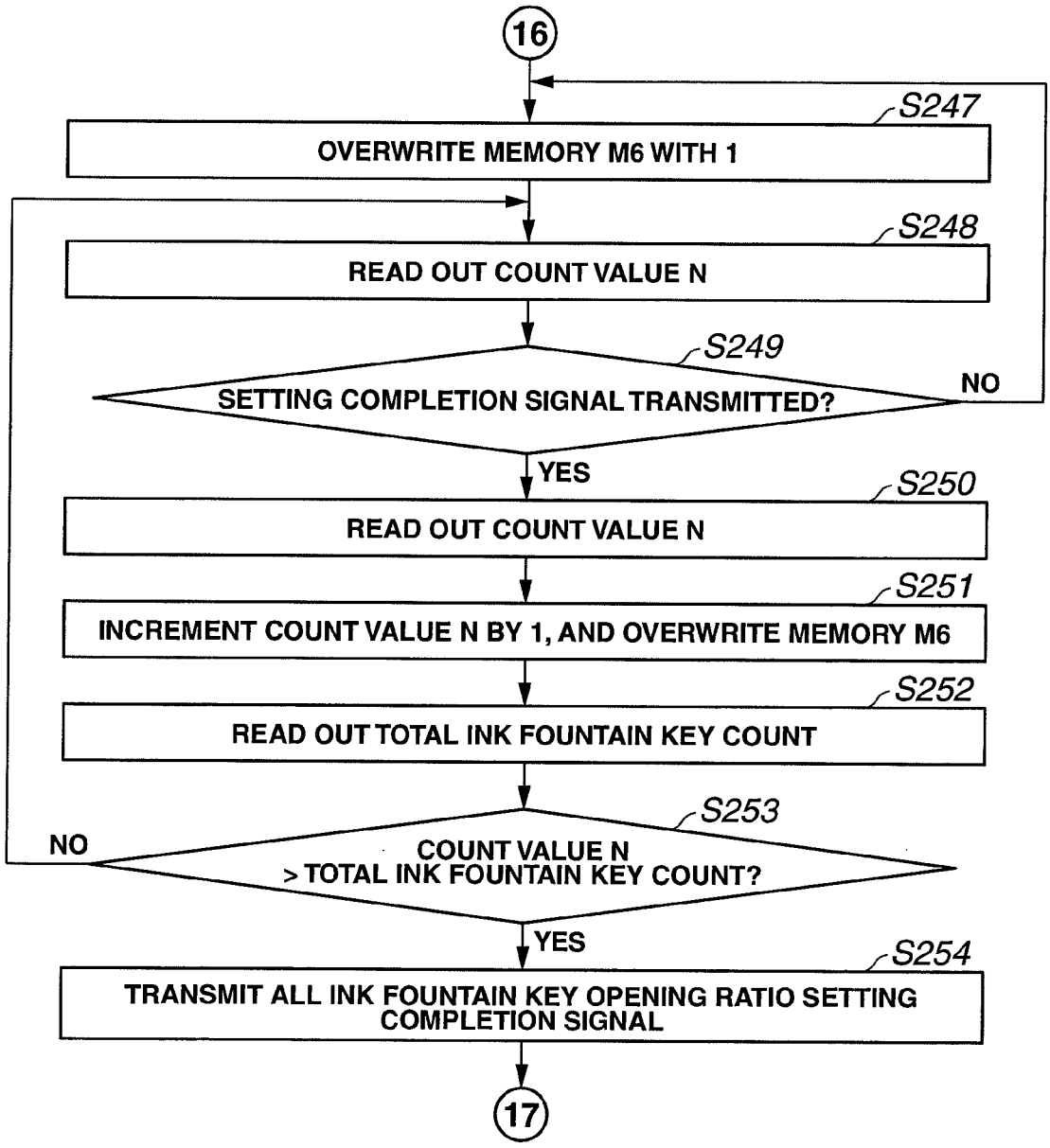
Figure 7R:
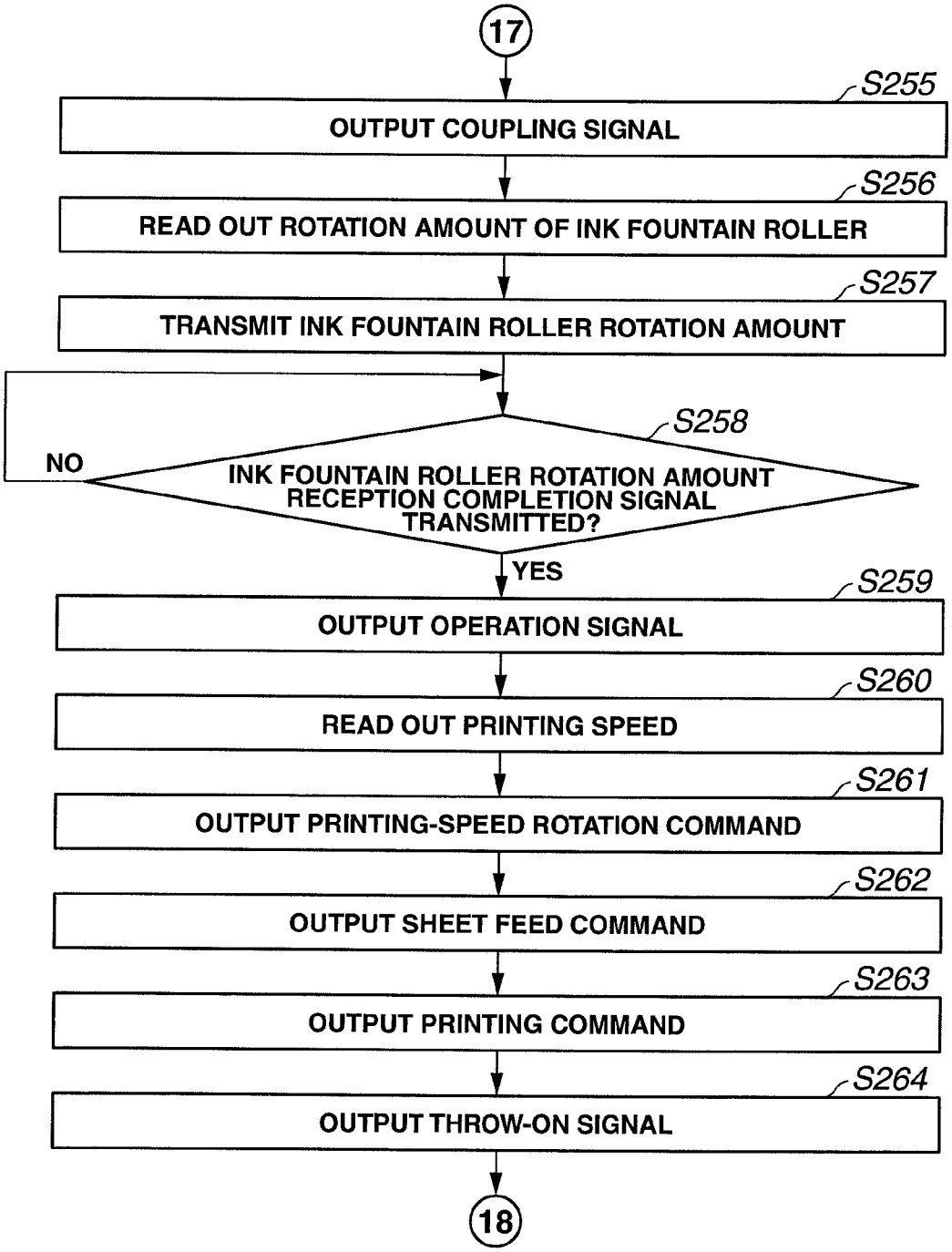

After transmitting the all ink fountain key opening ratio setting completion signal to all the ink fountain key control apparatuses 300 (step S228), the CPU 10 reads out the rotation amount of the ink fountain roller that is stored in the memory M11 (step S229). The CPU 10 transmits the readout rotation amount of the ink fountain roller to the ink fountain roller control apparatus 200 (FIG. 7O: step S230). If the CPU 10 receives an ink fountain roller rotation amount reception completion signal from the ink fountain roller control apparatus 200 (YES in step S231), it outputs an operation signal to the ink ductor device 27 (step S232), and starts the ink feed operation of the ink ductor roller 5. The CPU 10 continues the ink feed operation of the ink ductor roller 5 until the number of revolutions of the printing press reaches the number N3 of revolutions in the preliminary ink feed operation in the memory M4 (steps S233 to S237).

More specifically, the CPU 10 outputs a reset signal and enable signal to the counter 26 for counting the number of revolutions of the printing press (step S233). The CPU 10 stops the output of the reset signal to the counter 26 for counting the number of revolutions of the printing press (step S234), and starts, from 0, the count operation of the counter 26 for counting the number of revolutions of the printing press. The CPU 10 reads out the count value of the counter 26 for counting the number of revolutions of the printing press, and stores it in the memory M12 (step S235). The CPU 10 reads out the number N3 of revolutions in the preliminary ink feed operation from the memory M4 (step S236). The CPU 10 repeats the processing operations in steps S235 to S237 until the count value of the counter 26 for counting the number of revolutions of the printing press reaches the number N3 of revolutions in the preliminary ink feed operation (YES in step S237).

As a result, the ink film thickness distribution MeA in preliminary ink feed is formed in the upstream roller subgroup 6A (FIG. 6G).

In the preliminary ink feed, the ink supply amount changes slightly at a portion having a low image area ratio (low opening ratio of the ink fountain key) even with the same density difference, and greatly at a portion having a high image area ratio (high opening ratio of the ink fountain key) even with the same density difference. The ink supply amount can be set to an appropriate value regardless of the image area ratio of a range corresponding to each ink fountain key. Immediately after preliminary ink feed, a proper printing product can be printed.

In the embodiment, the opening ratio $\theta_N'$ (N=1 to n) of the ink fountain key in preliminary ink feed is calculated using the correction coefficient β based on the rotation amount of the ink fountain key, as represented by equation (1). The opening ratio $\theta_N'$ (N=1 to n) of the ink fountain key in preliminary ink feed can be made more accurate, and a proper printing product can be obtained more quickly.

Although the correction coefficient β based on the rotation amount of the ink fountain key is used to calculate the opening ratio $\theta_N'$ of the ink fountain key in preliminary ink feed in the embodiment, it may not always be used.

[Setting to Modified Opening Ratio (Opening Ratio in Printing after Preliminary Ink Feed) of Ink Fountain Key]

If the count value of the counter 26 reaches the number N3 of revolutions in the preliminary ink feed operation (YES in step S237), the CPU 10 overwrites the count value N in the memory M6 with N=1 (FIG. 7P: step S238), and reads out the count value N from the memory M6 (step S239). The CPU 10 reads out the modified opening ratio $\theta_N''$ of the Nth ink fountain key from the memory M21 (step S240), and transmits it to the Nth ink fountain key control apparatus 300 (step S241).

If the CPU 10 receives an Nth ink fountain key opening ratio reception completion signal from the Nth ink fountain key control apparatus 300 (YES in step S242), it reads out the count value N from the memory M6 (step S243). The CPU 10 increments the count value N by one, and overwrites the memory M6 with it (step S244). The CPU 10 reads out the total ink fountain key count n from the memory M8 (step S245). The CPU 10 repeats the processing operations in steps S239 to S246 until the count value N exceeds the total ink fountain key count n (YES in step S246). The modified opening ratios $\theta_1''$ to θn" are then transmitted to the ink fountain key control apparatuses 300-1 to 300-n.

[Confirmation of Completion of Setting Opening Ratio of Ink Fountain Key]

The CPU 10 overwrites the count value N in the memory M6 with N=1 (FIG. 7Q: step S247), and reads out the count value N from the memory M6 (step S248). The CPU 10 confirms the presence/absence of an ink fountain key opening ratio setting completion signal from the Nth ink fountain key control apparatus 300 (step S249).

If the CPU 10 confirms that the Nth ink fountain key control apparatus 300 has transmitted the ink fountain key opening ratio setting completion signal (YES in step S249), it reads out the count value N from the memory M6 (step S250). The CPU 10 increments the count value N by one, and overwrites the memory M6 with it (step S251). The CPU 10 reads out the total ink fountain key count n from the memory M8 (step S252). The CPU 10 repeats the processing operations in steps S248 to S253 until the count value N exceeds the total ink fountain key count n (YES in step S253).

If the count value N exceeds the total ink fountain key count n (YES in step S253), the CPU 10 determines that the setting of the opening ratios of the ink fountain keys has been completed. The CPU 10 transmits an all ink fountain key opening ratio setting completion signal to all the ink fountain key control apparatuses 300 (300-1 to 300-n) (step S254).

[Recoupling of Ink Roller Group]

After transmitting the all ink fountain key opening ratio setting completion signal to all the ink fountain key control apparatuses 300 (step S254), the CPU 10 outputs a coupling signal to the roller group division/coupling pneumatic cylinder valve 29 (FIG. 7R: step S255) to couple again the upstream roller subgroup 6A and downstream roller subgroup 6B and return them to the single ink roller group 6 (FIG. 6H).

[Test Reprinting]

The CPU 10 reads out the rotation amount of the ink fountain roller that is stored in the memory M11 (step S256). The CPU 10 transmits the readout rotation amount of the ink fountain roller to the ink fountain roller control apparatus 200 (step S257). If the CPU 10 receives an ink fountain roller rotation amount reception completion signal from the ink fountain roller control apparatus 200 (YES in step S258), it outputs an operation signal to the ink ductor device 27 (step S259), and starts the ink feed operation of the ink ductor roller 5.

The CPU 10 reads out the printing speed Vp from the memory M5 (step S260). The CPU 10 outputs a rotation command to the drive motor driver 22 via the D/A converter 24 (step S261), and sets the printing speed Vp as the speed of the printing press. The CPU 10 outputs a sheet feed command to the sheet feeder 33 (step S262) to start sheet feed to the printing press. The CPU 10 outputs a printing command to the printing unit 34 (step S263). In addition, the CPU 10 outputs a throw-on signal to the valve 36 (step S264) to throw on the ink form rollers 6-1 to 6-4. The CPU 10 starts printing (test reprinting) using the printing plate 7.

In this case, an ink film thickness distribution (ink film thickness distribution in final test reprinting) in printing using the printing plate 7 is formed while ink is consumed from the end of the ink roller group 6 during printing (during test reprinting). At this time, the ink film thickness distribution MdB in the downstream roller subgroup 6B becomes thinner than that during normal printing. Thus, ink flows from the upstream side to the downstream side faster than in normal printing. The corrected ink film thickness distribution Mf (FIG. 6I) is formed quickly in the ink roller group 6.

Figure 7S:
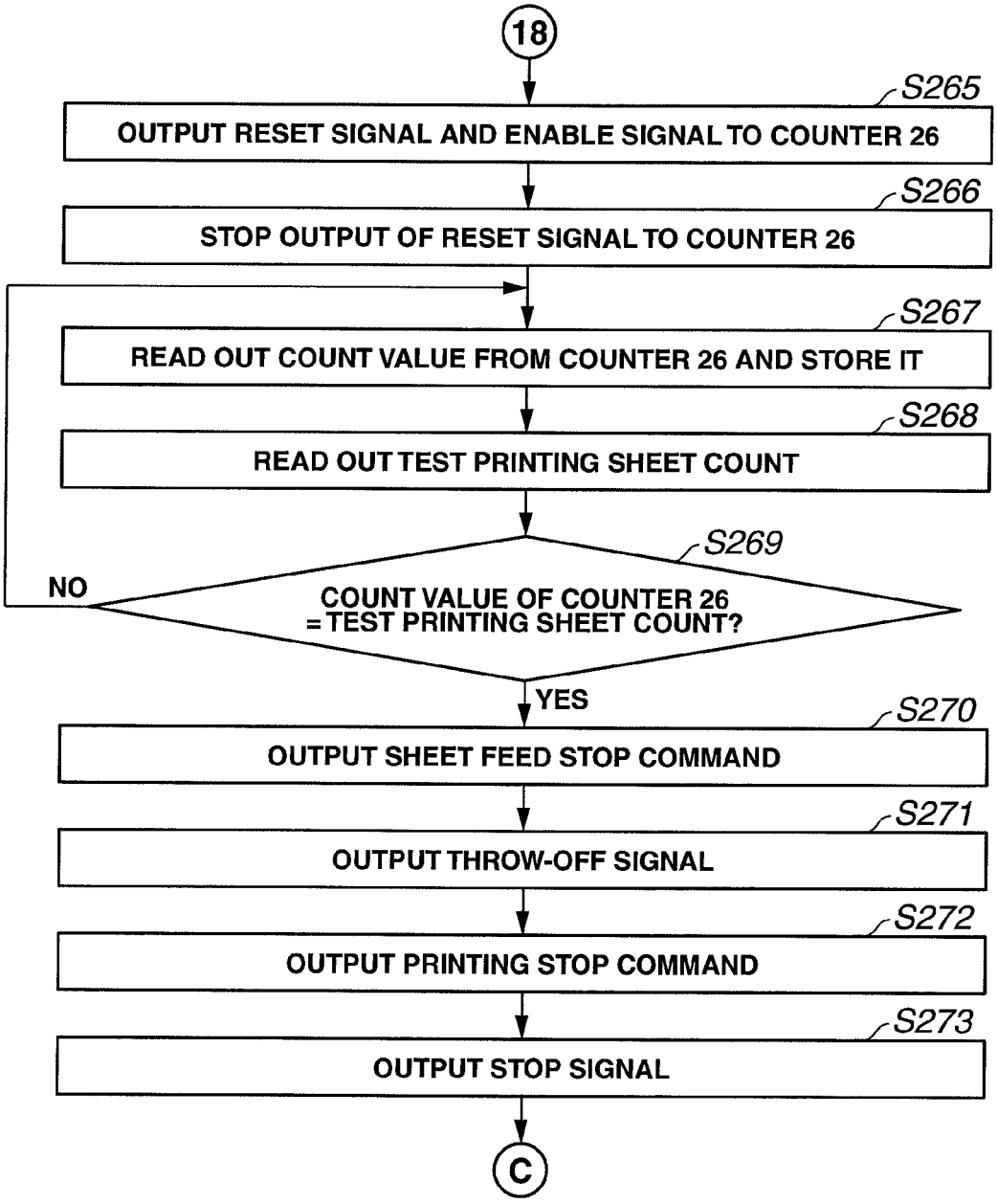

The CPU 10 continues the test reprinting until the number of revolutions of the printing press reaches the test printing sheet count Px in the memory M1 (FIG. 7S: steps S265 to S269). If the count value of the counter 26 reaches the test printing sheet count Px (YES in step S269), the CPU 10 outputs a sheet feed stop command to the sheet feeder 33 to stop sheet feed (step S270). The CPU 10 outputs a throw-off signal to the valve 36 (step S271) to throw off the ink form rollers 6-1 to 6-4. The CPU 10 outputs a printing stop command to the printing unit 34 (step S272), and outputs a stop command to the motor driver 22 (step S273) to stop the printing press.

[Final Printing]

If the density of the printing product is proper, the operator turns on the printing start switch 20. If the density of the printing product is improper, the above-described density measurement (steps S159 to S188), density modification (steps S190 to S255), and test reprinting (steps S256 to S273) are repeated.

If the printing switch 20 has been turned on (FIG. 7G: YES in step S274), the CPU 10 reads out the rotation amount of the ink fountain roller that is stored in the memory M11 (step S275). The CPU 10 transmits the readout rotation amount of the ink fountain roller to the ink fountain roller control apparatus 200 (step S276). If the CPU 10 receives an ink fountain roller rotation amount reception completion signal from the ink fountain roller control apparatus 200 (YES in step S277), it outputs an operation signal to the ink ductor device 27 (step S278), and starts the ink feed operation of the ink ductor roller 5.

The CPU 10 reads out the printing speed Vp from the memory M5 (step S279). The CPU 10 outputs a rotation command to the drive motor driver 22 via the D/A converter 24 (step S280), and sets the printing speed Vp as the speed of the printing press. The CPU 10 outputs a sheet feed command to the sheet feeder 33 (step S281) to start sheet feed to the printing press. The CPU 10 outputs a printing command to the printing unit 34 (step S282). Further, the CPU 10 outputs a throw-on signal to the ink form roller throw-on/off pneumatic cylinder valve 36 (step S283) to throw on the ink form rollers 6-1 to 6-4. The CPU 10 starts printing (final printing) using the printing plate 7. Hence, final printing is performed after obtaining a satisfactory printing product by test reprinting.

[Ink Fountain Roller Control Apparatus]

Figure 8:
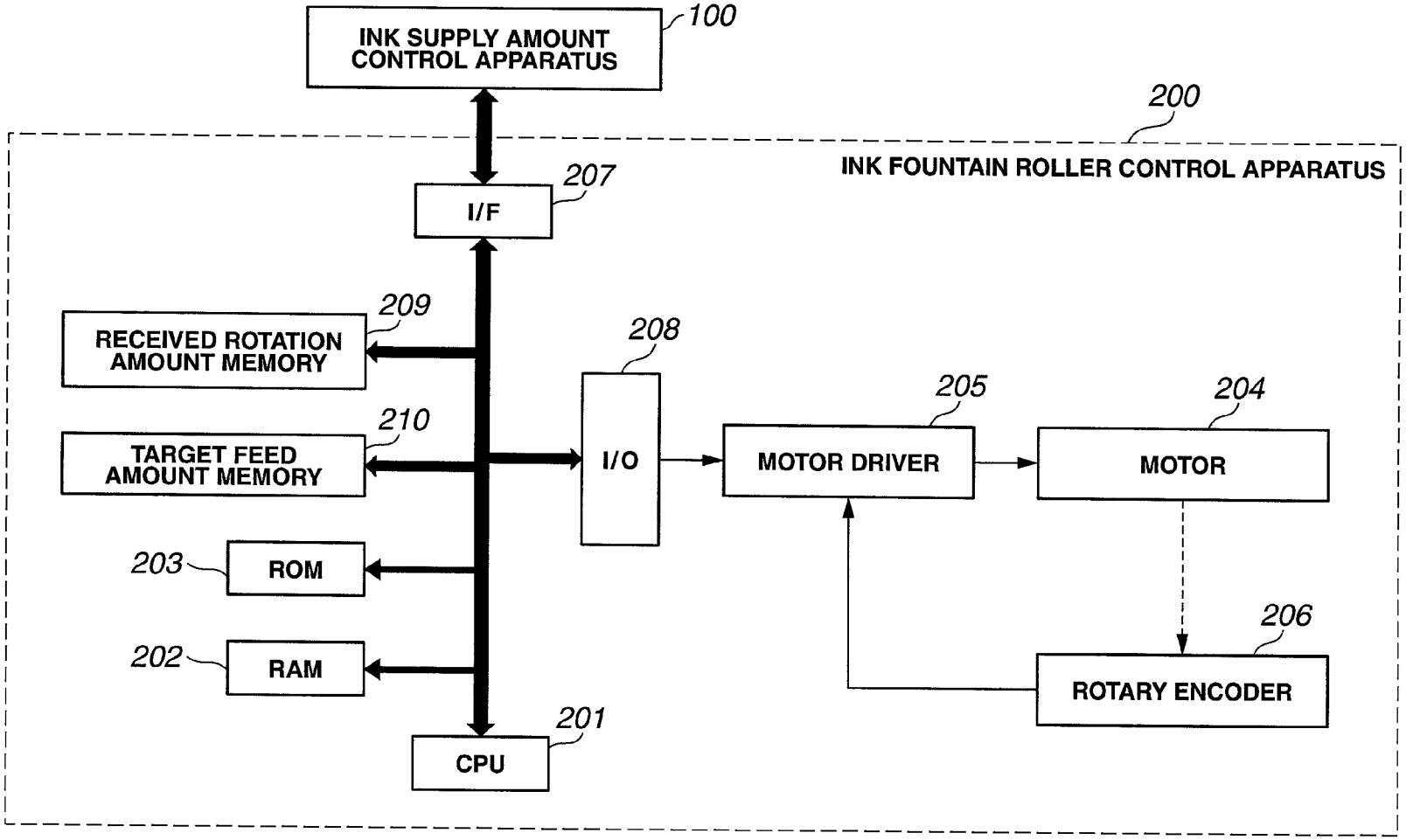
FIG. 8 is a block diagram showing the schematic arrangement of an ink fountain roller control apparatus shown in FIG. 1.

As shown in FIG. 8, the ink fountain roller control apparatus 200 includes a CPU 201, a RAM 202, a ROM 203, an ink fountain roller drive motor 204, an ink fountain roller drive motor driver 205, an ink fountain roller drive motor rotary encoder 206, input/output interfaces (I/O I/Fs) 207 and 208, and memories 209 and 210. The ink fountain roller control apparatus 200 is connected to the ink supply amount control apparatus 100 via the interface 207. The memory 209 stores a received rotation amount of the ink fountain roller. The memory 210 stores the target feed amount of the ink fountain roller.

Figure 9:
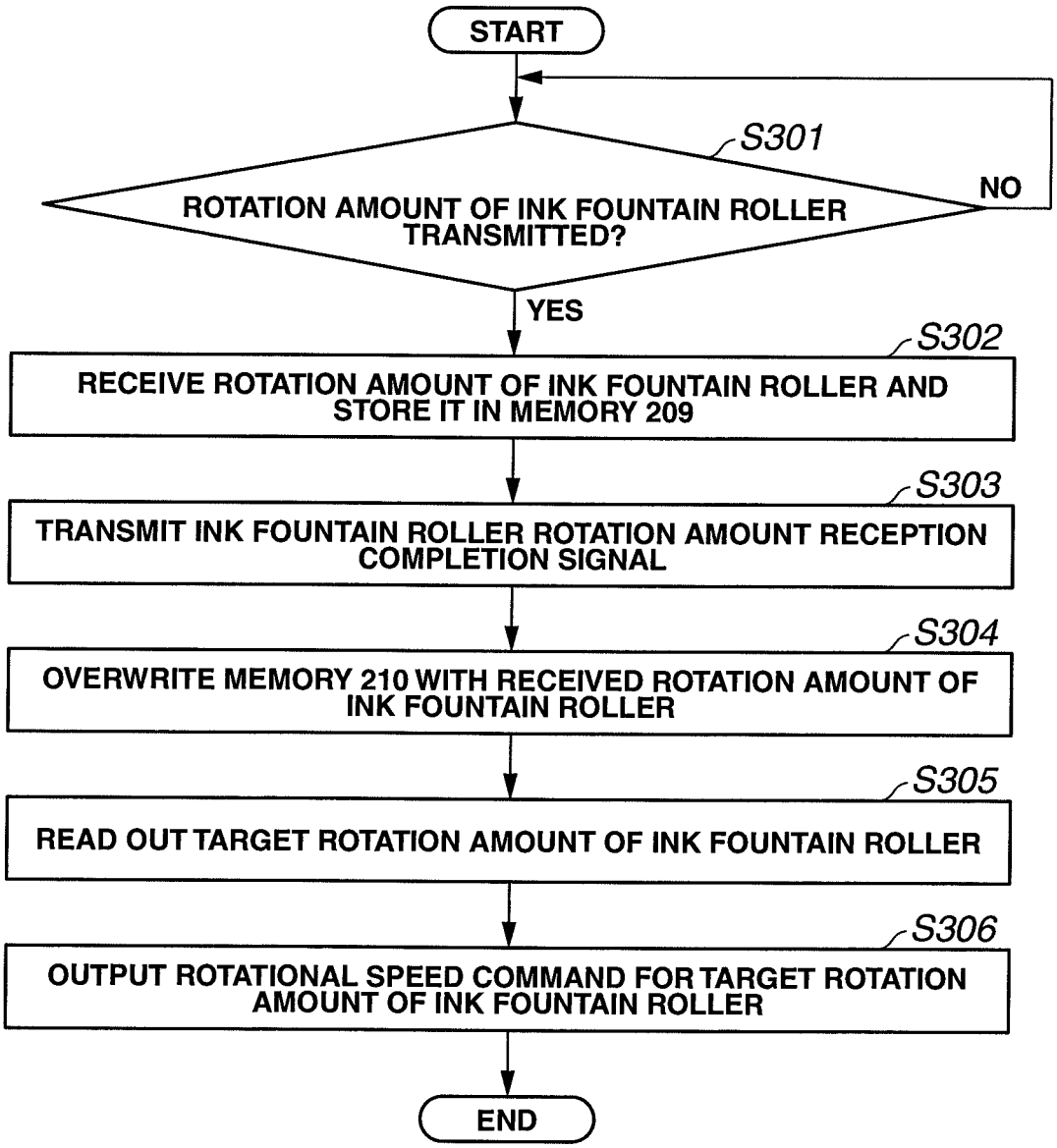
FIG. 9 is a flowchart showing the processing operation of the ink fountain roller control apparatus shown in FIG. 8.

If the ink supply amount control apparatus 100 has transmitted the rotation amount of the ink fountain roller (FIG. 9: YES in step S301), the CPU 201 stores the received rotation amount in the memory 209 (step S302). The CPU 201 then transmits an ink fountain roller rotation amount reception completion signal to the ink supply amount control apparatus 100 (step S303). The CPU 201 stores the received rotation amount of the ink fountain roller as the target feed amount (target rotation amount) of the ink fountain roller in the memory 210 (step S304). The CPU 201 reads out the target rotation amount from the memory 210 (step S305), sends it to the motor driver 205, and adjusts the rotation amount of the motor 204 to coincide with the target rotation amount (step S306).

[Ink Fountain Key Control Apparatus]

Figure 10:
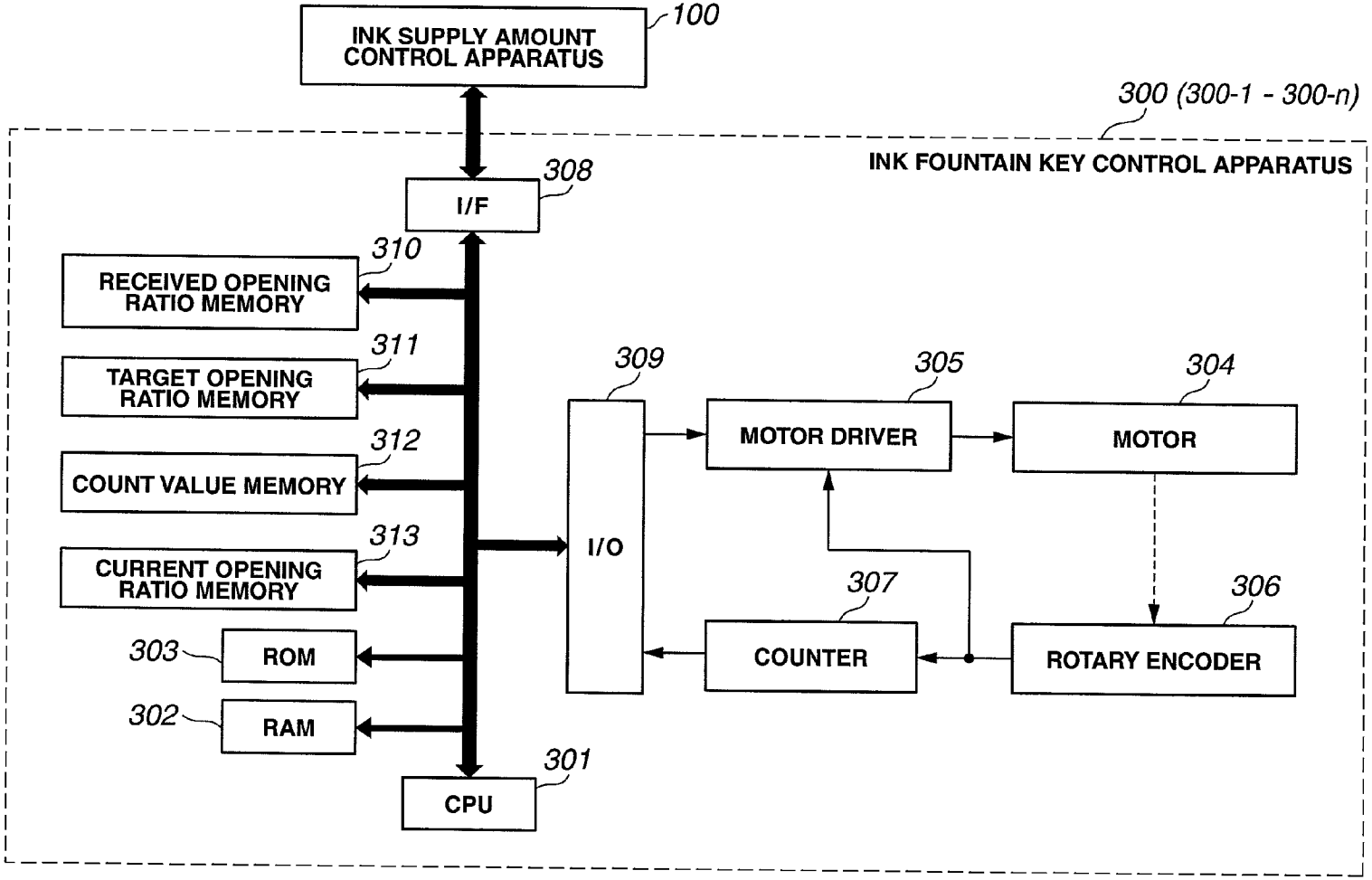
FIG. 10 is a block diagram showing the schematic arrangement of an ink fountain key control apparatus shown in FIG. 1.

As shown in FIG. 10, the ink fountain key control apparatus 300 includes a CPU 301, a RAM 302, a ROM 303, an ink fountain key drive motor 304, an ink fountain key drive motor driver 305, an ink fountain key drive motor rotary encoder 306, a counter 307, input/output interfaces (I/O I/Fs) 308 and 309, and memories 310 to 313. The ink fountain key control apparatus 300 is connected to the ink supply amount control apparatus 100 via the interface 308. The memory 310 stores a received opening ratio of the ink fountain key. The memory 311 stores the target opening ratio of the ink fountain key. The memory 312 stores the count value of the counter 307. The memory 313 stores the current opening ratio of the ink fountain key.

Figure 11A:
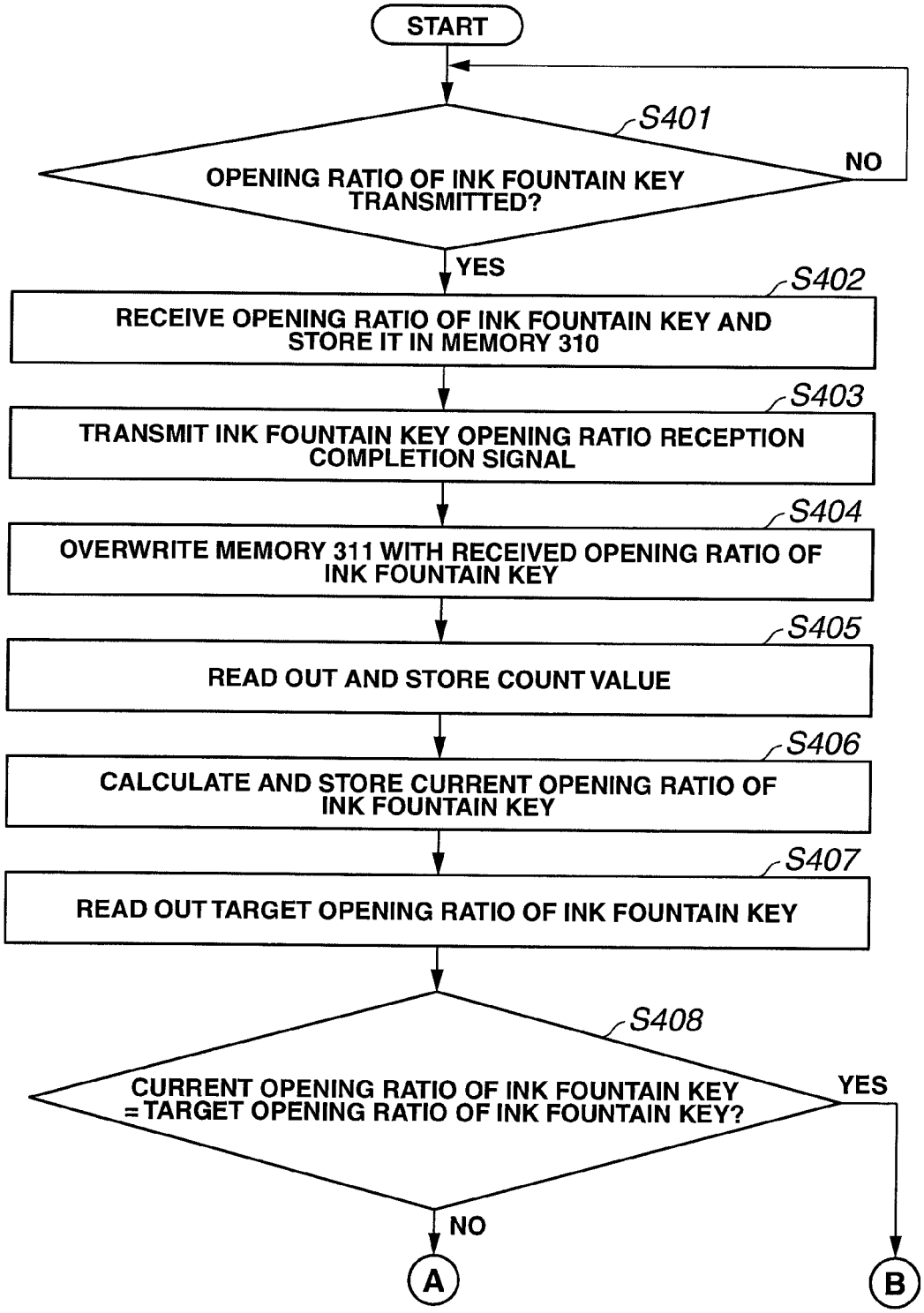
FIGS. 11A and 11B are flowcharts showing the processing operation of the ink fountain key control apparatus shown in FIG. 10.

If the ink supply amount control apparatus 100 has transmitted the opening ratio of the ink fountain roller (FIG. 11A: YES in step S401), the CPU 301 stores the received opening ratio in the memory 310 (step S402). The CPU 201 then transmits an ink fountain key opening ratio reception completion signal to the ink supply amount control apparatus 100 (step S403). The CPU 201 stores the received opening ratio of the ink fountain key as a target opening ratio in the memory 311 (step S404).

Figure 11B:
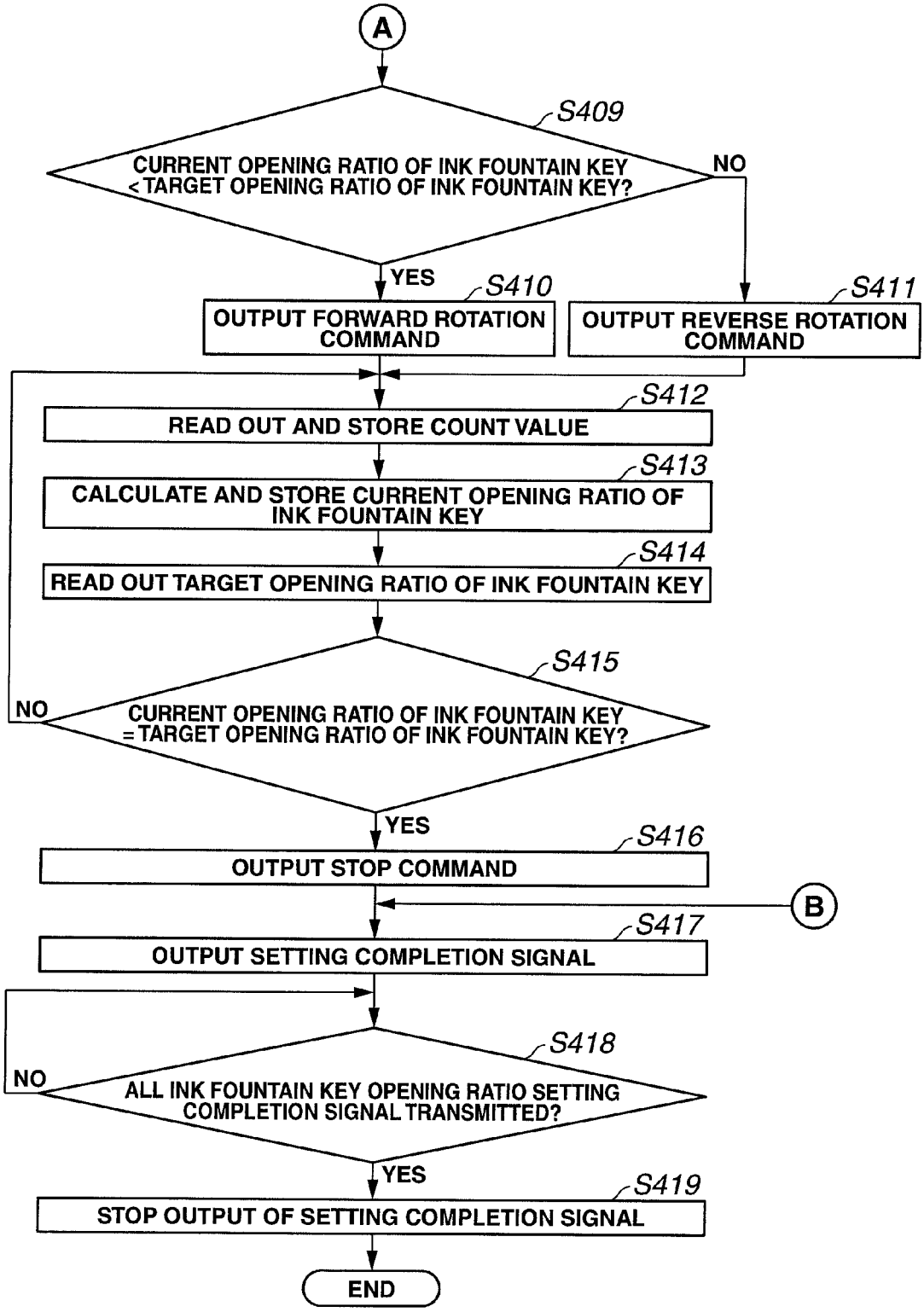

The CPU 301 reads the count value of the counter 307 and stores it in the memory 312 (step S405). The CPU 301 obtains the current opening ratio of the ink fountain key from the read count value of the counter 307, and stores it in the memory 313 (step S406). The CPU 301 reads out the target opening ratio of the ink fountain key from the memory 311 (step S407). If the current opening ratio of the ink fountain key is equal to the target opening ratio (YES in step S408), the process directly advances to step S417 (FIG. 11B). The CPU 301 outputs an ink fountain key opening ratio setting completion signal to the ink supply amount control apparatus 100.

If the current opening ratio of the ink fountain key is different from the target opening ratio (NO in step S408), the CPU 301 drives the ink fountain key drive motor 304 until the current opening ratio of the ink fountain key becomes equal to the target opening ratio (FIG. 11B: steps S409 to S416). After that, the CPU 301 outputs an ink fountain key opening ratio setting completion signal to the ink supply amount control apparatus 100 (step S417).

More specifically, if the current opening ratio of the ink fountain key is lower than the target opening ratio (YES in step S409), the CPU 301 sends a forward rotation command to the ink fountain key drive motor driver 305 (step S410). The CPU 301 reads out the count value from the counter 307 (step S412), and calculates the current opening ratio of the ink fountain key from the count value (step S413). The CPU 301 reads out the target opening ratio of the ink fountain key from the memory 311 (step S414). The CPU 301 repeats the processing operations in steps S412 to S415 until the current opening ratio of the ink fountain key coincides with the target opening ratio of the ink fountain key (YES in step S415).

If the current opening ratio of the ink fountain key is higher than the target opening ratio (NO in step S409), the CPU 301 sends a reverse rotation command to the ink fountain key drive motor driver 305 (step S411). The CPU 301 reads out the count value from the counter 307 (step S412), and calculates the current opening ratio of the ink fountain key from the count value (step S413). The CPU 301 reads out the target opening ratio of the ink fountain key from the memory 311 (step S414). The CPU 301 repeats the processing operations in steps S412 to S415 until the current opening ratio of the ink fountain key coincides with the target opening ratio of the ink fountain key (YES in step S415).

If the current opening ratio of the ink fountain key coincides with the target opening ratio of the ink fountain key in step S415 (YES in step S415), the CPU 301 outputs a stop command to the motor driver 305 (step S416), and outputs an ink fountain key opening ratio setting completion signal to the ink supply amount control apparatus 100 (step S417).

After outputting the ink fountain key opening ratio setting completion signal to the ink supply amount control apparatus 100 (step S417), the CPU 301 stops the output of the ink fountain key opening ratio setting completion signal to the ink supply amount control apparatus 100 (step S419) upon receiving an all ink fountain key opening ratio setting completion signal from the ink supply amount control apparatus 100 (YES in step S418).

In the above-described embodiment, in step S194 (FIG. 7K), the opening ratio $\theta_N'$ of each ink fountain key in preliminary ink feed is calculated using the image area ratio $S_N$ of a range corresponding to the ink fountain key, as represented by equation (1). Instead of the image area ratio $S_N$ of a range corresponding to each ink fountain key, the image area of a range corresponding to each ink fountain key may be used. Alternatively, the current opening ratio of each ink fountain key may be used.

In step S196 (FIG. 7K), the modified opening ratio (opening ratio in printing after preliminary ink feed) $\theta_N''$ of each ink fountain key is calculated using the image area ratio $S_N$ of a range corresponding to the ink fountain key, as represented by equation (2). Instead of the image area ratio $S_N$ of a range corresponding to each ink fountain key, the image area of a range corresponding to each ink fountain key may be used. Also, the current opening ratio of each ink fountain key may be used.

For example, when the current opening ratio of each ink fountain key is used, the current opening ratio of the ink fountain key is defined as $\theta_N$, and the opening ratio $\theta_N'$ of each ink fountain key in preliminary ink feed is calculated using equation (3):

$$\theta_N'=\alpha\cdot\Delta D_N\cdot\theta_N\cdot\beta \tag{3}$$

Further, the modified opening ratio (opening ratio in printing after preliminary ink feed) $\theta_N''$ of each ink fountain key is calculated using equation (4):

$$\theta_N''=\theta_N-\alpha\cdot\Delta D_N\cdot\theta_N \tag{4}$$

The above-described embodiment has exemplified processing of dividing the ink roller group into a plurality of roller subgroups in the following order. That is, the ink form roller throw-off operation is performed during test printing or final printing (step S155). Then, the ink feed operation of the ink ductor roller is stopped (step S202), and the ink roller group is divided into a plurality of roller subgroups (step S203). However, the present invention is not limited to this, and these three processes may be performed in an arbitrary order.

In the above-described embodiment, the ink roller group 6 is divided into the two, upstream roller subgroup 6A and downstream roller subgroup 6B. However, the ink roller group 6 may be divided into a larger number of subgroups such as three or four. Although ink in some of the divided roller subgroups is removed, ink may be removed from a plurality of roller subgroups as long as these roller subgroups are some of the divided roller subgroups.

In the above-described embodiment, the ink roller group 6 is divided and coupled using the swing arm 51. However, the mechanism of dividing and coupling the ink roller group 6 is not limited to the mechanism using the swing arm.

In the above-described embodiment, the ink film thickness distribution of the ink roller group 6 is corrected during test printing. However, the ink film thickness distribution of the ink roller group 6 can be corrected in the same manner even during final printing.

As described above, according to the embodiment, while the ink form rollers are thrown off during test printing or final printing, and the ink feed operation of the ink ductor roller is stopped, the ink roller group is divided into a plurality of roller subgroups. Then, ink in some of the divided roller subgroups is removed. Although the ink roller group is divided into a plurality of roller subgroups in the present invention, the number of roller subgroups is arbitrary such as two or more. Although ink in some of the divided roller subgroups is removed in the present invention, ink may be removed from a plurality of roller subgroups as long as these roller subgroups are some of the divided roller subgroups.

In an arrangement capable of dividing the ink roller group into two roller subgroups, the ink roller group is divided into upstream and downstream roller subgroups. Ink is removed from some of the divided roller subgroups, e.g., the upstream roller subgroup. In this case, the ink in the upstream roller subgroup cannot be returned to the ink fountain because the ink feed operation of the ink ductor roller stops. Since the upstream roller subgroup is disconnected from the downstream roller subgroup, the ink cannot be removed by blank sheet printing. In the present invention, therefore, the ink in the upstream roller subgroup is removed not by "ink return to fountain" or blank sheet printing, but by, e.g., using the ink cleaning device or scraping the ink by the blade.

In the arrangement capable of dividing the ink roller group into two roller subgroups, ink in the upstream roller subgroup is removed, and then the ink-removed upstream roller subgroup and the downstream roller subgroup are coupled and return to the single ink roller group. In this case, the ink form rollers are thrown off, so ink during test printing or final printing remains in the downstream roller subgroup. In this state, the single ink roller group is driven to rotate by an arbitrary number of revolutions. Then, the ink remaining in the downstream roller subgroup is leveled between the downstream roller subgroup and the upstream roller subgroup, forming a thin, flat ink film thickness distribution (basic ink film thickness distribution) in the ink roller group.

In the arrangement capable of dividing the ink roller group into two roller subgroups, the ink roller group is divided again into upstream and downstream roller subgroups. While an opening ratio in preliminary ink feed is set as the opening ratio of each ink fountain key, the ink feed operation of the ink ductor roller is performed by a predetermined number of times, forming an ink film thickness distribution in preliminary ink feed in the redivided upstream roller subgroup. In this state, the basic ink film thickness distribution is formed in the downstream roller subgroup, and the ink film thickness distribution in preliminary ink feed is formed in the upstream roller subgroup.

In the arrangement capable of dividing the ink roller group into two roller subgroups, after forming the ink film thickness distribution in preliminary ink feed in the upstream roller subgroup, the upstream roller subgroup in which the ink film thickness distribution in preliminary ink feed is formed and the downstream roller subgroup in which the basic ink film thickness distribution is formed are coupled again and return to the single ink roller group. After the return to the single ink roller group, an opening ratio in printing after preliminary ink feed is set as the opening ratio of each ink fountain key. In this state, the ink form rollers are thrown on to restart printing using the printing plate.

In this case, the ink film thickness distribution (ink film thickness distribution in final test printing or final printing) in printing using the printing plate is created during printing (during test printing or final printing), that is, while consuming ink from the end of the ink roller group. At this time, the ink film thickness distribution in the downstream roller subgroup becomes thinner than that during normal printing. Thus, ink flows from the upstream side to the downstream side faster than in normal printing. A corrected ink film thickness distribution is formed quickly in the ink roller group.

What is claimed is:

1. An ink film thickness distribution correction method in an ink supply apparatus including an ink fountain storing an ink, a plurality of ink fountain keys arranged in the ink fountain, an ink fountain roller to which the ink is supplied from the ink fountain in accordance with opening ratios of the plurality of ink fountain keys, an ink ductor roller to which the ink is transferred from the ink fountain roller by an ink feed operation, and an ink roller group including at least one ink form roller to which the ink transferred to the ink ductor roller is supplied, comprising the steps of:

performing a throw-off operation of the ink form roller positioned at an end of the ink roller group during test printing or final printing;

stopping the ink feed operation of the ink ductor roller during test printing or final printing;

dividing the ink roller group into a plurality of roller subgroups during test printing or final printing; and removing the ink in at least one of roller subgroups out of the divided roller subgroups.

2. A method according to claim 1, further comprising the steps of:

after removing the ink in at least one of roller subgroups, coupling the divided roller subgroups to return to the single ink roller group; and driving the coupled ink roller group to rotate by a predetermined number of times.

3. A method according to claim 2, further comprising the steps of:

measuring density values of density measurement patches printed in ranges corresponding to the plurality of ink fountain keys on a printing sheet before an ink removal operation;

obtaining opening ratios of the plurality of ink fountain keys in preliminary ink feed based on differences between the measured density values of the density measurement patches and preset reference density values, and image area ratios of the ranges corresponding to the plurality of ink fountain keys;

setting the obtained opening ratios in preliminary ink feed as opening ratios of the plurality of ink fountain keys;

after driving the single ink roller group, dividing again the ink roller group into a plurality of roller subgroups; and after dividing again the ink roller group into the plurality of roller subgroups and setting the opening ratios of the plurality of ink fountain keys, forming an ink film thickness distribution in preliminary ink feed in an upstream roller subgroup out of the redivided roller subgroups by performing the ink feed operation of the ink ductor roller by a predetermined number of times.

4. A method according to claim 3, further comprising the steps of:

before the ink removal operation, obtaining opening ratios of the plurality of ink fountain keys in printing after preliminary ink feed based on the differences between the measured density values of the density measurement patches and the preset reference density values, and the image area ratios of the ranges corresponding to the plurality of ink fountain keys;

setting the obtained opening ratios in printing after preliminary ink feed as opening ratios of the plurality of ink fountain keys;

after forming an ink film thickness distribution in preliminary ink feed in the upstream roller subgroup, coupling again the redivided roller subgroups to return to the single ink roller group; and after coupling again the roller subgroups and setting the opening ratios of the plurality of ink fountain keys, restarting printing using a printing plate by performing a throw-on operation of the ink form roller.

* * * * *